US006634820B2

(12) United States Patent
Kobayashi et al.

(10) Patent No.: US 6,634,820 B2
(45) Date of Patent: Oct. 21, 2003

(54) PRINTER SYSTEM

(75) Inventors: Takakazu Kobayashi, Kawasaki (JP); Yukitoshi Takano, Kawasaki (JP); Tamotsu Nishiura, Kawasaki (JP); Hiroshi Kaneyama, Kawasaki (JP); Seiichi Kurihara, Kawasaki (JP); Tetsu Takahashi, Kawasaki (JP); Shigenori Sasaki, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 134 days.

(21) Appl. No.: 09/810,255

(22) Filed: Mar. 19, 2001

(65) Prior Publication Data

US 2002/0031390 A1 Mar. 14, 2002

(30) Foreign Application Priority Data

Sep. 8, 2000 (JP) ..... 2000-273828

(51) Int. Cl.[7] ..... B41J 29/42
(52) U.S. Cl. ..... 400/709; 400/61
(58) Field of Search ..... 400/709, 708, 400/706, 711, 709.1, 61, 70, 76; 347/229, 231, 238, 248, 249; 399/2, 4, 6

(56) References Cited

U.S. PATENT DOCUMENTS 5,237,644 A * 8/1993 Shinohara ..... 395/111
5,831,744 A * 11/1998 Kataoka ..... 358/296
6,007,261 A * 12/1999 Fujita et al. ..... 400/61
6,014,537 A 1/2000 Van Aken et al. ..... 399/271
6,024,505 A * 2/2000 Shinohara ..... 400/605
6,055,386 A * 4/2000 Kato et al. ..... 399/49
6,078,400 A * 6/2000 Mizutani ..... 358/1.14

FOREIGN PATENT DOCUMENTS

| | | |
|---|---|---|
| JP | 56-21288 | 2/1981 |
| JP | 57-147788 | 9/1982 |
| JP | 62-25555 | 2/1987 |
| JP | 5-301673 | * 11/1993 |
| JP | 6-155846 | 6/1994 |
| JP | 2000-187360 | 7/2000 |

* cited by examiner

*Primary Examiner*—Ren Yan
(74) *Attorney, Agent, or Firm*—Armstrong, Westerman & Hattori, LLP

(57) ABSTRACT

The present invention provides a printer system that performs a printing operation on recording sheets of various types. In accordance with the present invention, the image of a recording sheet on which recording sheet identification information for identifying the type of the recording sheet and data identification information for identifying the type of print data is printed in advance is picked up by an image pick-up device. From the picked up image, the recording sheet identification information and the data identification information are extracted and then compared so as to detect inconsistency between the type of the recording sheet and the type of the data. By this printing system, a data printing operation can be performed on desired recording sheets.

16 Claims, 24 Drawing Sheets

FIG.2A

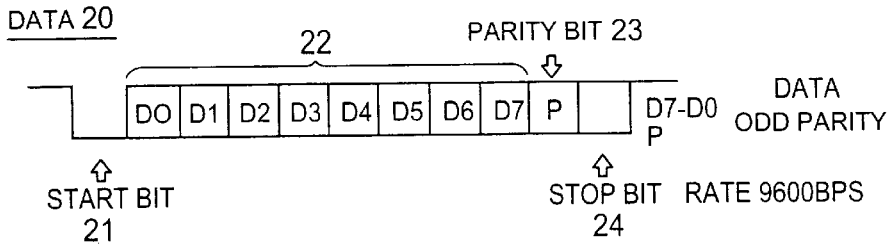

FIG.2B

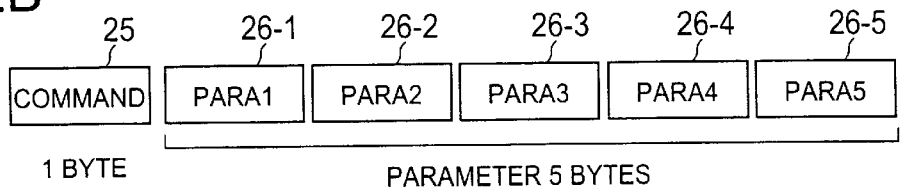

FIG.2C

| COMMAND CODE | ABBREVIATION | COMMAND | FUNCTIONS |
|---|---|---|---|
| 80 | MODE | OPERATION CONDITION NOTIFICATION | NOTIFYING THE SHEET LENGTH,DEVICE TYPE,ETC. |
| 90 | PSTRT | PRINT START | START PRINTING FOR 1 PAGE |
| 91 | TSTRT | START TEST PRINTING | START TEST PRINTING FOR 1 PAGE |
| 92 | NOPRT | START BLANK PRINTING | START BLANK PRINTING FOR 1 PAGE |
| 9F | CANSTA | START CANCEL | CANCELING PRINT START |
| A0 | ATLOD | AUTOLOAD | START AUTOLOADING A SHEET |
| AF | CANLOD | CANCEL AUTOLOAD | CANCEL AUTOLOADING A SHEET |
| B0 | EJECT | SHEET EJECT | DISCHARGING A SHEET |
| F0 | STAREQ | STATUS REQUEST | NOTIFY THE PRINTER OF CONDITION OF THE VERIFICATION DEVICE |

FIG.2D

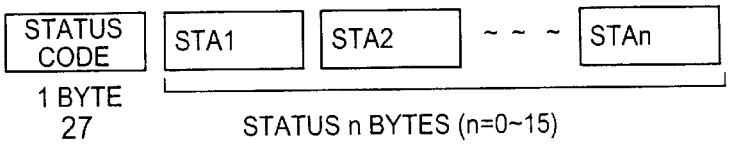

PRINTER SYSTEM

BACKGROUND OF THE INVENTION

1. Field of the Invention

The present invention generally relates to printer systems, and, more particularly, to a printer system that performs a printing operation on recording sheets of different types.

2. Description of the Related Art

A printer device for business use prints a large quantity of client data accumulated in a host computer on recording sheet. Such a printer device performs a high-speed data printing operation on jointed recording sheets. Also, depending on the types of data, the data printing operation is performed on recording sheets of different formats. In such a case, it is necessary to change recording sheets.

If the recording sheets are not change, there is inconsistency between the type of the recording sheet and the type of the data. Therefore, it is necessary to check whether or not the type of the recording sheet corresponds to the type of the data.

Conventionally, whether or not the type of the recording sheet corresponds to the type of the data is visually checked after a series of printing jobs.

However, there are several types of recording sheets used in this type of printing system, and the data printing positions are similar among those recording sheets. In such a case, since the data is printed at a correct location, whether or not the recording sheet corresponds to the data cannot be visually checked. Even if inconsistency between the recording sheet and the data can be visually checked, the printing time and sheet used so far become a waste, because the series of printing jobs have been completed.

SUMMARY OF THE INVENTION

A general object of the present invention is to provide printer systems in which the above disadvantages are eliminated.

A more specific object of the present invention is to provide a printer system that performs an accurate data printing operation on a desired recording sheet.

The above objects of the present invention is to provide a printer system which prints data containing data identification information for identifying the type of data to be printed on a predetermined recording sheet having recording sheet identification information for identifying the type of recording sheet printed in advance thereon. This printer system comprises: an image pick-up unit that picks up an image of the recording sheet; and a processing unit that extracts images of the recording sheet identification information and the data identification information from the image of the recording sheet picked up by the image pick-up unit, compares the recording sheet identification information with the data identification information, and detects inconsistency between the type of the recording sheet and the type of the data.

With this printer system, the image of the recording sheet identification information and the data identification information are compared so as to detect inconsistency between the type of the recording sheet and the type of the data. Thus, the inconsistency detection can be accurate. When the inconsistency is detected, the printing operation is stopped so as to prevent unnecessary printing. Also, since the recording sheet identification information and the data identification information are obtained by one image obtaining process, the verification process can be quickly completed.

The above objects of the present invention are also achieved by a verification device that verifies a recording sheet on which recording sheet identification information for identifying a type of sheet is recorded in advance, and data containing data identification information for identifying a type of data to be printed is also printed. This verification device comprises: an image pick-up unit that picks up an image of the recording sheet; and a processing unit that extracts images of the recording sheet identification information and the data identification information from the image of the recording sheet picked up by the image pick-up unit, and compares the recording sheet identification information with the data identification information so as to detect inconsistency between a type of the recording sheet and a type of the data.

The above and other objects and features of the present invention will become more apparent from the following description taken in conjunction with the accompanying drawings.

BRIEF DESCRIPTION OF THE DRAWINGS

FIGS. 2A to 2D illustrate commands transmitted from a command transmission/reception unit to a verification device of the embodiment of the present invention;

DESCRIPTION OF THE PREFERRED EMBODIMENTS

The following is a description of embodiments of the present invention, with reference to the accompanying drawings.

Figure 1:
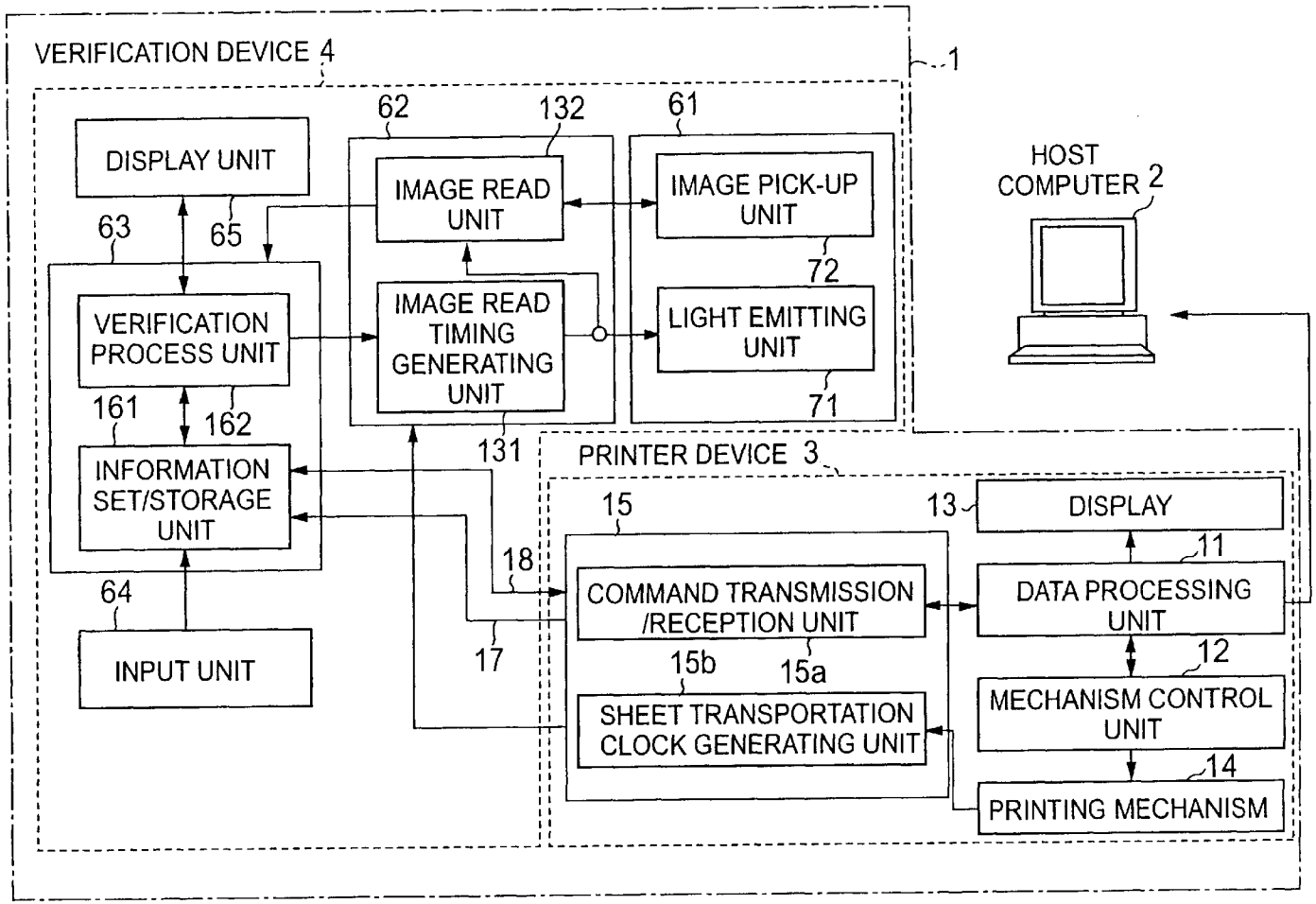
FIG. 1 is a block diagram of one embodiment of the present invention.

FIG. 1 is a block diagram of one embodiment of the present invention.

A printer system 1 of this embodiment is a system that prints data managed by a host computer 2 onto predetermined recording sheets. The printer system 1 comprises a printer device 3 and a verification device 4.

The printer device 3 comprises a data processing unit 11, a mechanism control unit 12, a display 13, a printing mechanism 14, and an interface unit 15. The data processing unit 11 receives data from the host computer 2, and generates commands and print data that are supplied to the mechanism control unit 12. The data processing unit 11 also displays the printing conditions of the device or errors on the display 12 based on the information supplied from the mechanism control unit 12 and the interface unit 15.

The mechanism control unit 12 controls the printing mechanism 14 in accordance with the command and print data supplied from the data processing unit 11. The printing mechanism 14 transports the recording sheets, and performs a printing operation on the recording sheets based on the print data.

The interface unit 15 serves as an interface between the printer device 3 and the verification device 4. The interface unit 15 comprises a command transmission/reception unit 15*a* and a sheet transportation clock generating unit 15*b*. The command transmission/reception unit 15*a* is connected to the verification device 4 by a communication line 16 and a signal line 17. The command transmission/reception unit 15*a* has serial communication with the verification device 4 via the communication line 16. By the serial communication, the command transmission/reception unit 15*a* transmits various commands to the verification device 4, and receives a status code from the verification device 4.

FIG. 2A shows the structure of data used in the communication between the command transmission/reception unit 15*a* and the verification device 4. FIG. 2B shows the structure of command data transmitted from the command transmission/reception unit 15*a* to the verification device 4. FIG. 2C shows command codes and functions. FIG. 2D shows the structure of data of a status code.

The data 20 transmitted between the command transmission/reception unit 15*a* and the verification device 4 has each 1 byte comprising a start bit 21, a data area 22, a parity bit 23, and a stop bit 24, as shown in FIG. 2A. Using the data shown in FIG. 2A, the communication is held between the command transmission/reception unit 15*a* and the verification device 4.

Commands are transmitted from the command transmission/reception unit 15*a* to the verification device 4. Each of the commands comprises a 1-byte command area 25 and 5-byte parameter units 26-1 to 26-5. In the command unit 25, command codes are set as shown in FIG. 2C. The commands transmitted from the command transmission/reception unit 15*a* to the verification device 4 include nine commands shown in FIG. 2C. Among the commands, a command code of hexadecimal "80" is mainly used. The hexadecimal "80" command code indicates an operation condition notification command. The operation condition notification command is a command for notifying the verification device 4 of the length of each sheet, the type of a device, and other conditions.

A status code is also transmitted from the verification device 4 to the command transmission/reception unit 15*a*. The status code comprises a 1-byte status code area 27 and a n-byte status byte unit, as shown in FIG. 2D. The maximum number of bytes of the n-byte status byte unit is 16.

The status code is used for an error notification from the verification device 4 to the command transmission/reception unit 15*a*. The command transmission/reception unit 15*a* receives an error notification from the verification device 4, and then supplies the error notification to the data processing unit 11. Receiving the error notification from the command transmission/reception unit 15*a*, the data processing unit 11 displays an error indication on the display 13, and controls the printing mechanism control unit 12 to stop the operation of the printing mechanism 14.

A valid/invalid signal for validating the verification is transmitted from the command transmission/reception unit 15*a* to the verification device 4 via the signal line 17. The verification device 4 controls the verification process in accordance with the valid/invalid signal transmitted through the signal line 17.

The sheet transportation clock generating unit 15*b* detects the transportation distance based on the operation of the printing mechanism 14, and generates the transportation clock that rises every time a sheet is moved by ⅙ inch. The transportation clock generated by the sheet transportation clock generating unit 15*b* is supplied to the verification device 4. Here, the transportation clock is used as the timing for cutting the sheet, for instance.

Figure 3:
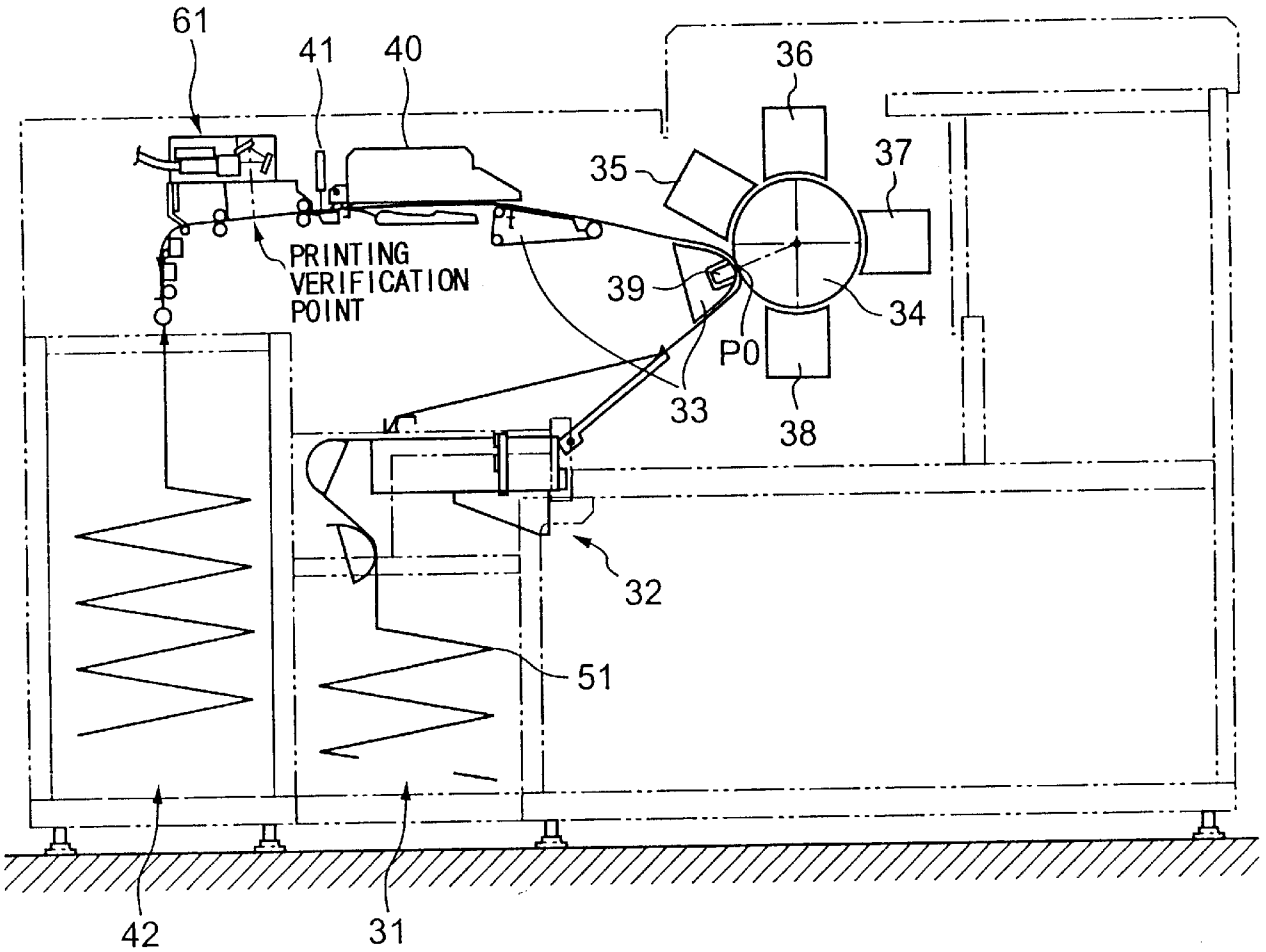
FIG. 3 is a schematic view of the structure of a printer device of the embodiment of the present invention.

FIG. 3 is a schematic view of the printer device 3 of this embodiment.

The printer device 3 comprises a sheet feeding unit 31, an autoloader unit 32, a tractor unit 33, a photosensitive drum 34, a cleaner unit 35, a charger unit 36, an exposure unit 37, a developer unit 38, a transfer unit 39, a fixing unit 40, a brush unit 41, and a stacker unit 42.

A printing sheet 51 is stacked in the sheet feeding unit 31. The printing sheet 51 is formed by jointed recording sheets.

Figure 4:
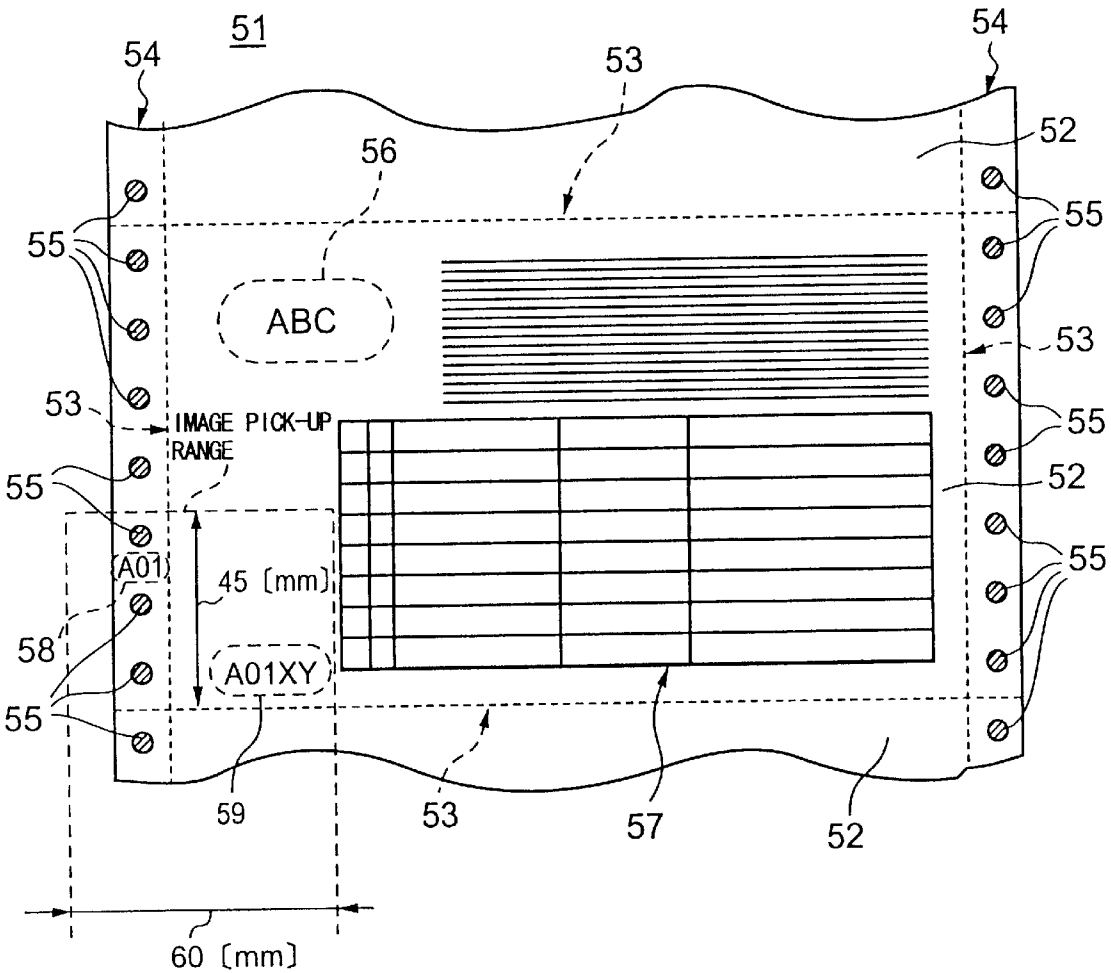
FIG. 4 shows the structure of a printing sheet used in the embodiment of the present invention.

FIG. 4 shows the structure of the printing sheet 51 of this embodiment.

The printing sheet 51 is formed by a plurality of jointed recording sheets 52 each having a predetermined length. The recording sheets 52 have scored lines 53. Along the scored lines 53, the recording sheets 52 can be detached from one another. The printing sheet 51 has an end portion 54 on its either side. Transportation holes 55 are formed at the end portions 54. The transportation holes 55 are engaged with the tractor unit 33 to transport the printing sheet 51. On the recording sheets 52, a logotype 56 and ruled lines 57 are printed in advance. Further, recording sheet identification information 58 for identifying the type of recording sheet is printed in one of the end portions 54. By recognizing the recording sheet identification information 58, the type of recording sheet can be identified.

In this embodiment, when the printer device 3 prints data on the recording sheets 52, data identification information 59 for identifying the type of data is printed at a predetermined location adjacent to the recording sheet identification information 58 printed on the recording sheets 52. In this embodiment, the recording sheet identification information 58 that is printed on the recording sheets 52 in advance and the data identification information 59 printed at the time of data printing are picked up as images. Based on the picked up recording sheet identification information 58 and the data identification information 59, it is determined whether or not the recording sheets correspond to the print data. By doing so, the codes for indicating the recording sheets can be eliminated from the print data. Accordingly, no changes need to be made to the large amount of print data managed by the host computer 2. Further, the analysis of the print data becomes unnecessary, and the transmission of the data identification information contained in the print data does not need to be transmitted from the printer device 3 to the verification device 4. Accordingly, there is no need to mount the structure required for the transmission to the printer device 3. Also, since the verification device 4 can be independently controlled, it is possible to employ the verification device 4 as an option for the printer device 3 at a later date.

The autoloader unit 32 loads the printing sheet 51 stacked in the sheet feeding unit 31 at a location to be engaged with the tractor unit 33. The tractor unit 33 transports the printing sheet 51 loaded by the autoloader unit 32. An image to be printed onto the printing sheet 51 are developed on the photosensitive drum 34. A toner image developed on the photosensitive drum 34 is transferred onto the printing sheet 51 and printed.

The photosensitive drum 34 first passes through the cleaner unit 35. The cleaner unit 35 removes the charges from the photosensitive drum 34, and flakes off the residual toner. The photosensitive drum 34 next passes through the charger unit 36, which uniformly charges the photosensitive drum 34.

The photosensitive drum 34 then passes through the exposure unit 37. The exposure unit 37 irradiates the uniformly charged photosensitive drum 34 with a laser beam based on the print data. The charges of the laser-irradiated portion on the photosensitive drum 34 are removed so as to form a latent image.

The photosensitive drum 34 then passes through the developer unit 38. The developer unit 38 charges the toner so as to adhere to the photosensitive drum 34 with electrostatic force, thereby forming an toner image on the photosensitive drum 43. After the formation of the toner image, the photosensitive drum 34 passes through the transfer unit 39. At this point, the printing sheet 51 is sandwiched between the photosensitive drum 34 and the transfer unit 39.

The transfer unit 39 transfers the toner image formed on the photosensitive drum 34 to the printing sheet 51. After the transfer of the printing sheet 51, the photosensitive drum 34 then passes through the cleaner unit 35 again to repeat the same procedures.

The printing sheet 51 on which the toner image is transferred is next supplied to the fixing unit 40, which fixes the toner image onto the printing sheet 51. After the fixing unit 40 fixes the toner image, the operation of printing the print data onto the printing sheet 51 is completed.

After the completion of the printing operation, the verification device 4 conducts a verification operation on the print data. After the verification operation, the printing sheet 51 is stacked in the stacker unit 42.

Next, the verification device 4 will be described.

As shown in FIG. 1, the verification device 4 comprises an image pick-up unit 61, an interface unit 62, a processing unit 63, an input unit 64, and a display unit 65.

The image pick-up unit 61 is attached onto the passage of the printing sheet 51 of the printer device 3, and picks up an image of a predetermined region of each of the recording sheets 52 that constitute the printing sheet 51. The image pick-up unit 61 comprises a light emitting unit 71 and an image pick-up device 72.

The light emitting unit 71 includes LEDs (Light Emitting Diode), and emits light onto the printing sheet 51. The image pick-up device 72 includes a CCD (Charge Coupled Device) camera, and picks up an image of the printing sheet 51.

Next, the image pick-up unit 61 will be described.

Figure 5:
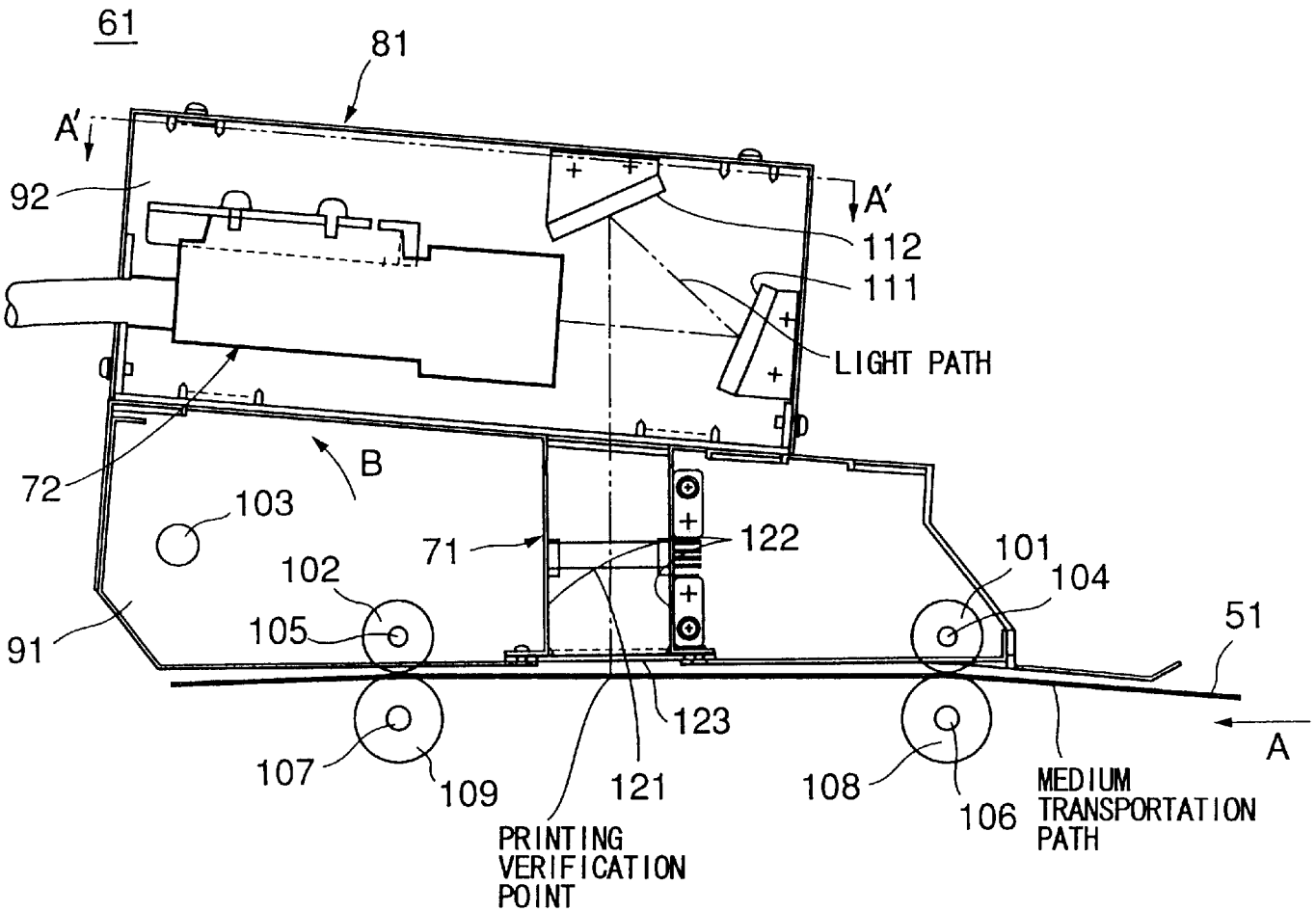
FIG. 5 is a longitudinal section of an image pick-up device used in the embodiment of the present invention.
Figure 6A:
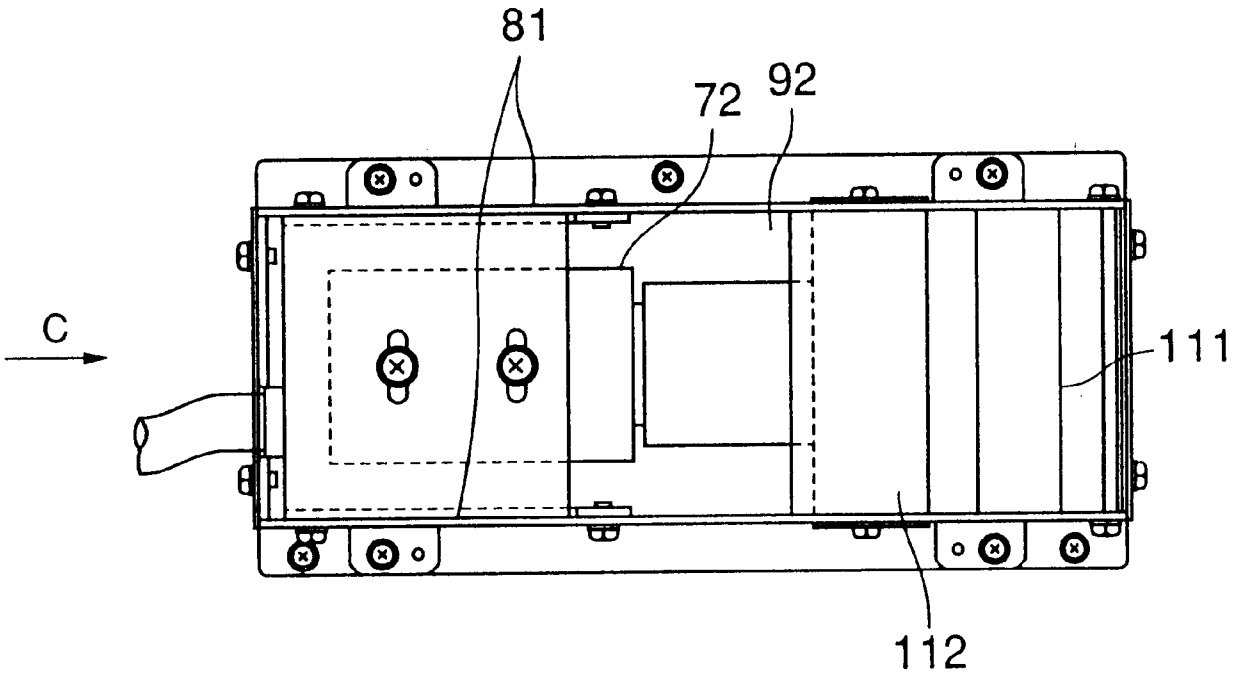
FIGS. 6A and 6B show the structure of the upper stage portion of the image pick-up device used in the embodiment of the present invention.
Figure 6B:
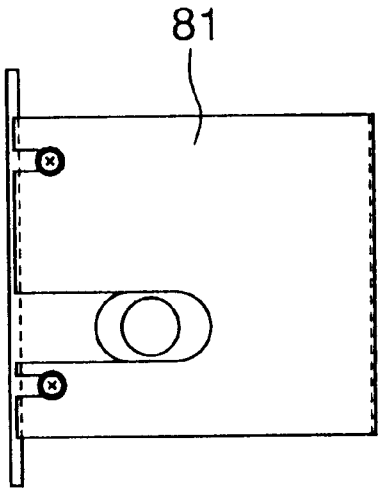
Figure 7:
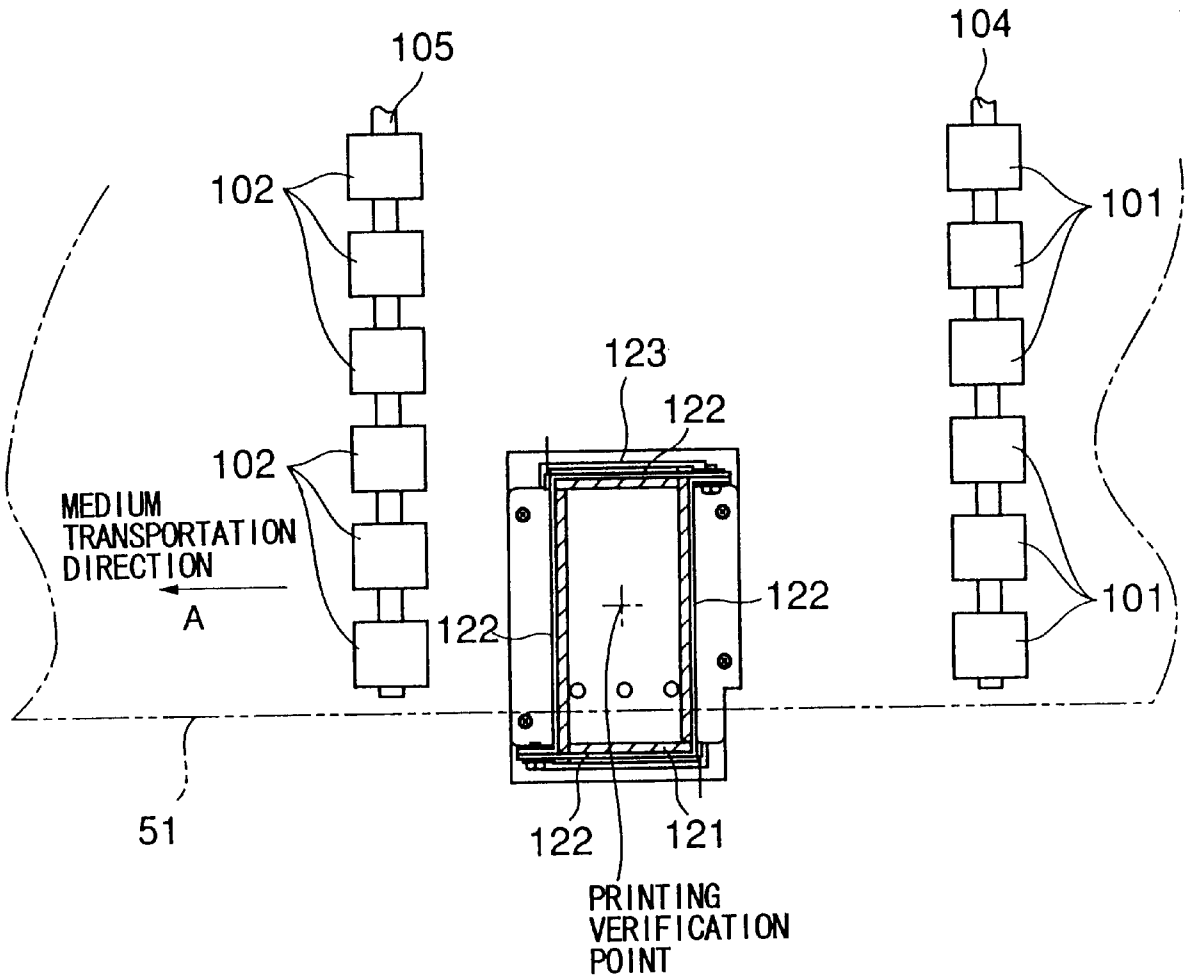
FIG. 7 shows the structure of a light emitting unit of the embodiment of the present invention.

FIG. 5 is a longitudinal section of the image pick-up device as one embodiment of the present invention. FIGS. 6A and 6B show the structure of the upper part of the image pick-up device as one embodiment of the present invention. FIG. 7 shows the structure of the light emitting unit as one embodiment of the present invention.

The image pick-up unit 61 contains the light emitting unit 71 and the image pick-up device 72 in a casing 81. The casing 81 has a two-stage structure that consists of a lower stage portion 91 and an upper stage portion 92. The lower stage portion 91 contains the light emitting unit 71, medium holding rollers 101 and 102, and a rotational axis 103. The upper stage portion 92 contains the image pick-up device 72 and mirrors 111 and 112.

The light emitting unit 71 comprises a lighting unit 121, a reflection plate 122, and a protection glass plate 123. The lighting unit 121 has the LEDs at the four corners of a rectangular placed in parallel with the bottom surface of the casing 81. The lighting unit 121 emits light toward the lower inner side of the rectangular. The reflection plate 122 is perpendicular to the bottom surface of the casing 81, and surrounds the lighting unit 121. The reflection plate 122 keeps the light emitted from the lighting unit 121 inside the lighting unit 121.

The protection glass plate 123 is placed on the bottom surface of the casing 81, and the light emitted from the lighting unit 121 passes through the protection glass plate 123. Thus, the protection glass plate 123 serves to protect the inside of the light emitting unit 71 from dust.

The medium holding rollers 101 and 102 rotate about rotational axes 104 and 105 in the direction perpendicular to the direction of the arrow A that is the transportation direction of the printing sheet 51. The medium holding rollers 101 and 102 slightly protrude downward from the bottom surface of the casing 81. Also, at the lower side of the bottom surface of the image pick-up unit 61, medium holding rollers 108 and 109 that are rotatably supported by rotational axes 106 and 107 situated in parallel with the rotational axes 104 and 105 are located in such a manner as to face the medium holding rollers 101 and 102. The printing sheet 51 is sandwiched between the medium holding rollers 101 and 102 and the medium holding rollers 108 and 109, and transported in the direction of the arrow A. The medium holding rollers 101, 102, 108, and 109 positions the printing surface of the printing sheet 51 with respect to the image pick-up device 72.

The lighting unit 71 irradiates the printing sheet 51 with light through the protection glass plate 123. The printing sheet 51 reflects the emitted light. The light reflected by the printing sheet 51 passes through the inside of the lighting unit 71, and reaches the upper stage portion 92. The light supplied from the lighting unit 71 to the upper stage portion 92 is then supplied to the mirror 112, which bends the light from the printing sheet 51 toward the mirror 111. The light from the mirror 111 is in turn supplied to the mirror 112, which reflects the light from the mirror 111 toward the image pick-up device 72. Thus, the image pick-up device 72 can pick up the image of the printing sheet 51.

The mirrors 111 and 112 make the light path from the printing sheet 51 to the image pick-up device 72 longer in a smaller space, compared with the prior art. Also, the mirror 111 and 112 also enable the pick-up of the image in an upright standing state.

The image pick-up unit 61 is rotatable about the rotational axis 103 in the direction of the arrow B.

Figure 8B:
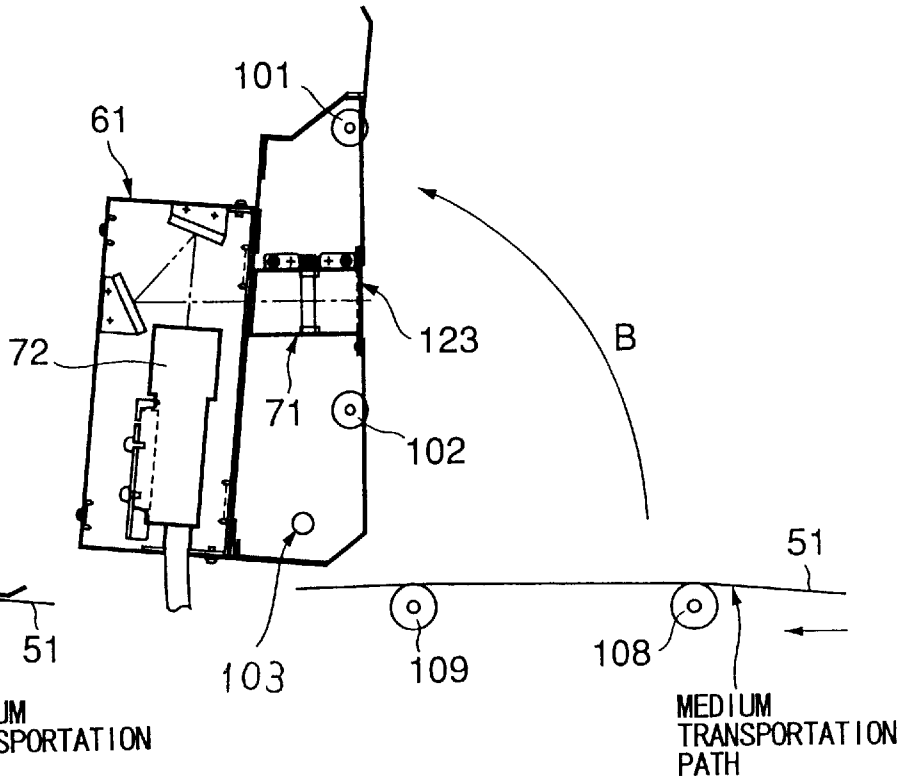
FIGS. 8A and 8B show an open-close operation of the image pick-up device of the embodiment of the present invention.
Figure 8A:
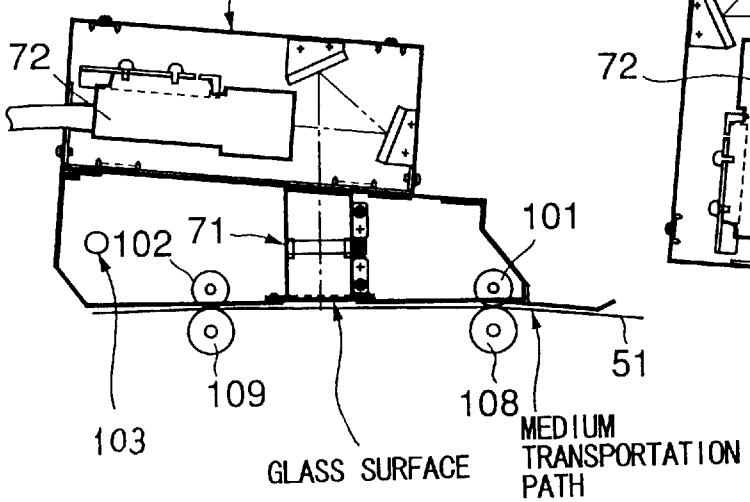

FIGS. 8A and 8B illustrate an open-close operation of the image pick-up unit as one embodiment of the present invention. More specifically, FIG. 8A shows the image pick-up unit when the cover is closed, and FIG. 8B shows the image pick-up unit when the cover is open.

The image pick-up unit 61 rotates about the rotational axis 103 in the direction of the arrow B, thereby exposing its bottom surface, as shown in FIG. 8B. With the bottom surface of the image pick-up unit 61 being exposed, dust and foreign matters can be wiped off the protection glass plate 123. Thus, the recording sheet identification information 58 and the data identification information 59 printed on the recording sheets 52 can be accurately picked up.

Figure 9:
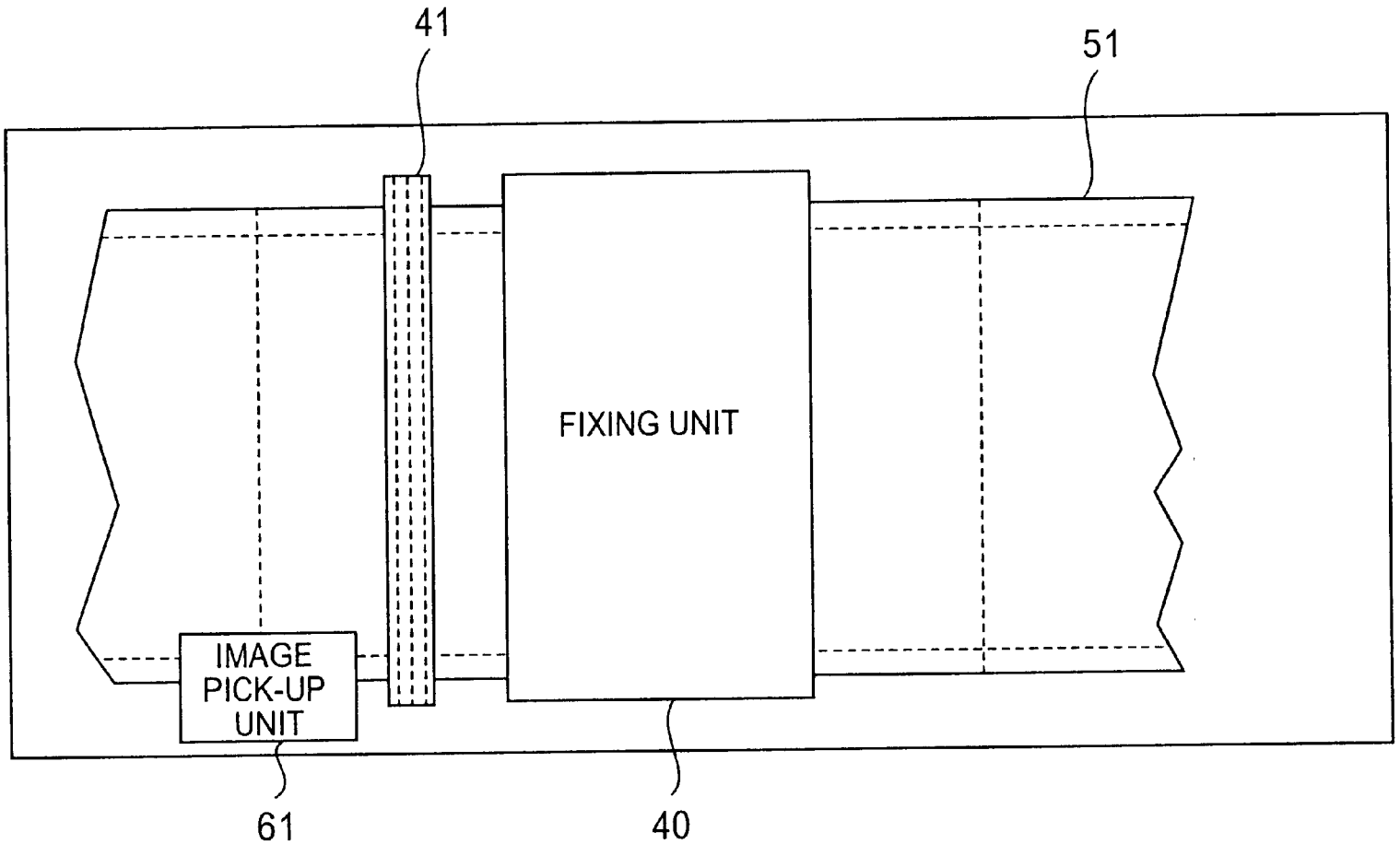
FIG. 9 illustrates an operation of a brush unit employed in the embodiment of the present invention.
Figure 10:
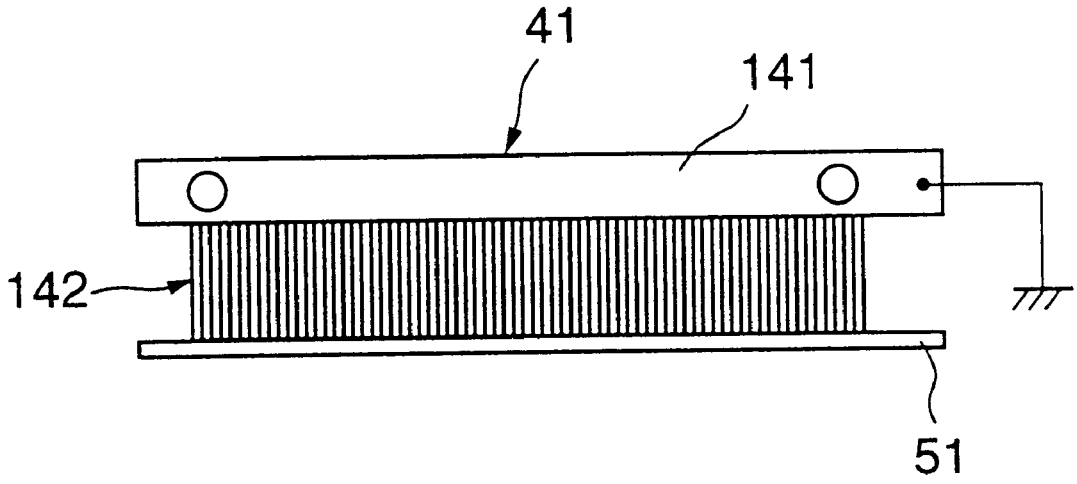
FIG. 10 shows the structure of the brush unit employed in the embodiment of the present invention.

FIG. 9 illustrates an operation of the brush unit of one embodiment of the present invention. FIG. 10 shows the structure of the brush unit of one embodiment of the present invention.

The brush unit 41 is interposed between the fixing unit 40 and the image pick-up unit 61, as shown in FIG. 9, and scrapes unfixed residual toner off the surface of the printing sheet 51. The brush unit 41 comprises a holding unit 141 and a brush 142, as shown in FIG. 10. The holding unit 141 is grounded and can be free of electrostatic force. The brush 142 is brought into contact with the surface of the printing sheet 51 so as to scrape off the residual toner. Thus, the printing sheet 51 can be protected from stain caused by the pick-up operation by the image pick-up unit 61. Accordingly, the verification device 4 can be prevented from making a wrong detection.

Referring back to FIG. 1, the explanation for the printer system will be continued.

An image picked up by the image pick-up device 72 is supplied to the interface unit 62. The interface unit 62 comprises an image obtaining timing generating unit 131 and an image obtaining unit 132.

The image obtaining timing generating unit 131 generates an image obtaining signal based on the sheet transportation clock generated by the sheet transportation clock generating unit 115*b* of the printer device 3. The image obtaining signal is generated every time the recording sheet identification information 58 of the recording sheet 52 and the data identification information 59 are both included in an image.

Figure 11:
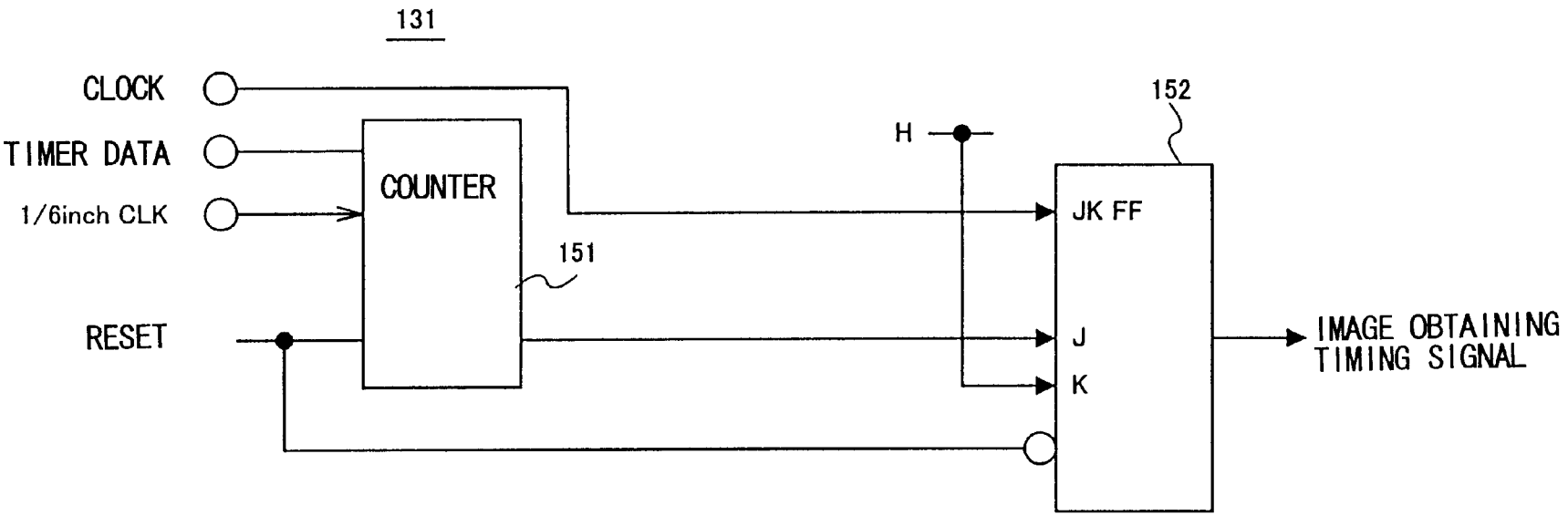
FIG. 11 is a block diagram of an image read timing generating unit employed in the embodiment of the present invention.

FIG. 11 is a block diagram of the image obtaining timing generating unit of one embodiment of the present invention.

The image obtaining timing generating unit 111 comprises a counter 151 and a flip-flop 152. The counter 151 receives the sheet transportation clock from the sheet transportation clock generating unit 15*b* of the printer device 3, and also receives timer data and a reset signal from the processing unit 63. The counter 151 is reset at predetermined timing in accordance with the reset signal supplied from the processing unit 63. The sheet transportation clock is counted until the count value reaches the timer data set by the processing unit 62. When the count value reaches the timer data, the counter 151 outputs a trigger signal. The trigger signal is supplied to the flip-flop 152. The flip-flop 152 is formed by a JK flop—flop. The trigger signal supplied from the counter 151 toggles the flip-flop 152, which then generates the image obtaining timing signal. The image obtaining timing signal generated by the flip-flop 152 is supplied to the light emitting unit 71 and the image obtaining unit 132.

In accordance with the image obtaining timing signal supplied from the flip-flop 152, the lighting unit 121 of the light emitting unit 71 emits light. In accordance with the image obtaining timing signal supplied from the flip-flop 152, the image obtaining unit 132 obtains an image from the image pick-up device 72.

Figures 12A, 12B, 12C:
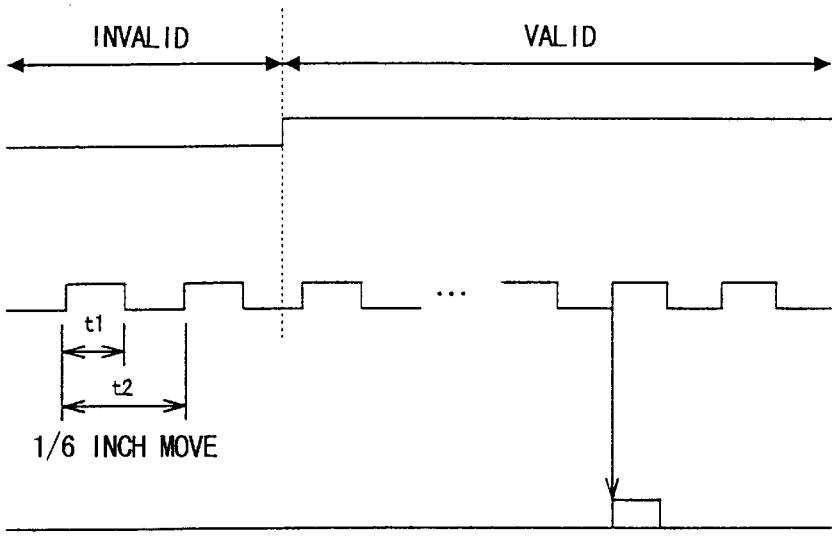
FIGS. 12A to 12C illustrate the image read timing in the embodiment of the present invention.

FIG. 12 illustrates the image obtaining timing in one embodiment of the present invention. More specifically, FIG. 12A shows a valid/invalid signal, FIG. 12B shows the sheet transportation clock, and FIG. 12C shows the image obtaining timing signal.

When the valid/invalid signal shown in FIG. 12A becomes valid, the counter 151 is reset and starts counting. The valid/invalid signal becomes valid when a predetermined period of time has passed since the start of autoloading of the printing sheet 51. The predetermined period of time is equivalent to the period of time starting from the beginning of the autoloading of the printing sheet 51 until the recording sheet identification information 58 of the recording sheets 52 and the data identification information 59 are found in a region to be picked up by the image pick-up unit 61.

The counter 151 counts the sheet transportation clock for the timer data after the valid/invalid signal shown in FIG. 12A becomes valid.

The timer data set in the counter 151 is equivalent to the length of each one of the recording sheets 52. Accordingly, when the counter 151 counts up for the timer data after the valid/invalid signal becomes valid, the recording sheet identification information 58 of the recording sheets 52 and the data identification information 59 are located in a region that can be picked up by the image pick-up unit 61. After the counting up, the counter 151 outputs the trigger signal. The flip-flop 152 is toggled by the trigger signal, and then outputs the image obtaining timing signal, as show in FIG. 12C. In accordance with the image obtaining timing signal, the lighting unit 121 emits light so that the recording sheet identification information 58 of the recording sheets 52 and the data identification information 59 can be accurately read.

The counter 151 continues outputting the trigger signal for each sheet length of the recording sheets 52. By doing so, the predetermined position of the recording sheets 52, i.e., the images of the recording sheet identification information 58 and the data identification information 59 can be continuously obtained.

The images obtained by the image obtaining unit 132 are supplied to the processing unit 63. The processing unit 63 extracts the recording sheet identification information 58 and the data identification information 59 from the images obtained by the image obtaining unit 132, and then conducts the verification process.

The processing unit comprises an information setting/storing unit 161 and a verification processing unit 162. The information setting/storing unit 161 includes a RAM and a ROM, and stores information that indicates the correspondence between verification areas, recording sheet identification number, and data identification numbers.

The input unit 64 comprises a keyboard and a mouse for inputting information in the information setting/storing unit 161. The display unit 65 comprises a CRT and an LCD, and displays the information set and stored by the information setting/storing unit 161 and the verification results of the verification processing unit 162.

Next, the verification process performed by the verification processing unit 162 will be described.

Figure 13:
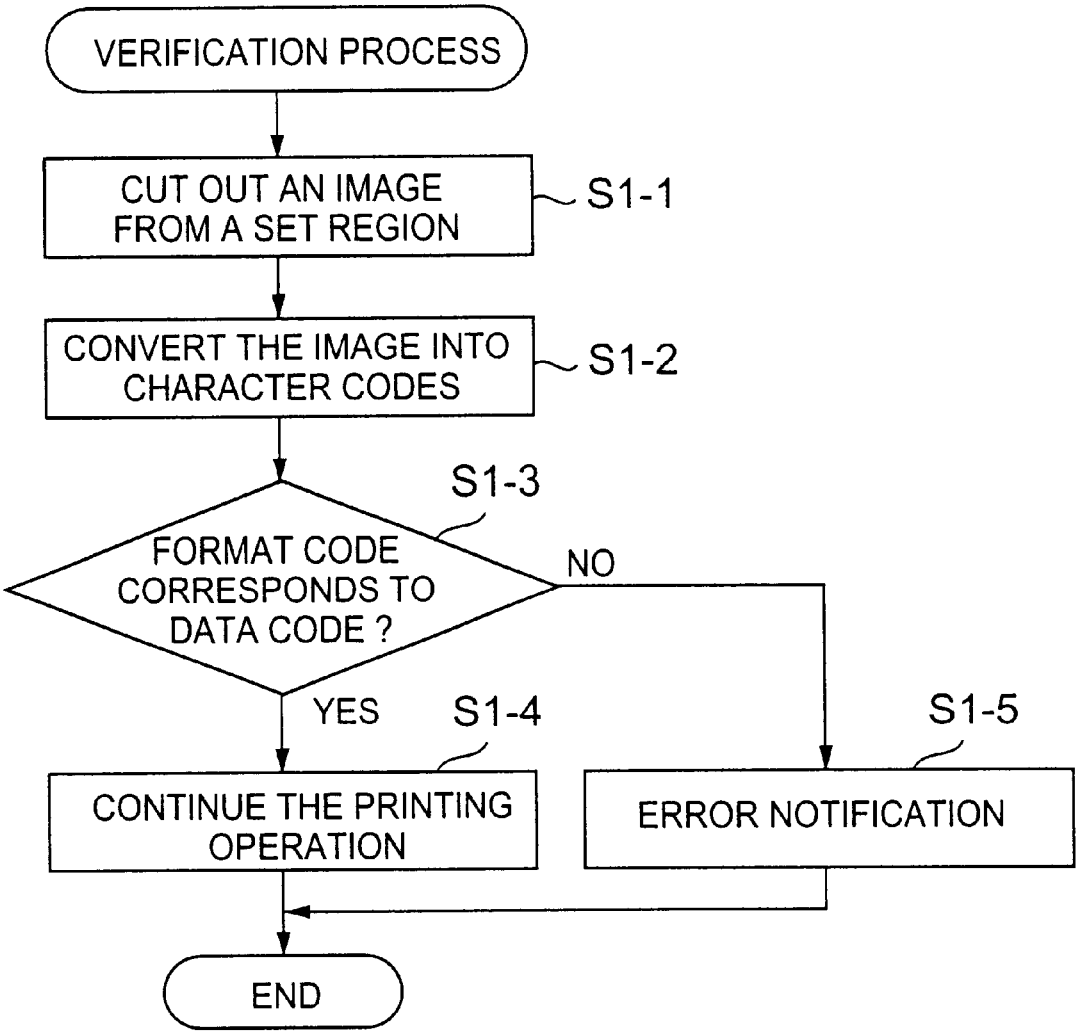
FIG. 13 is a flowchart of a verification process performed in the embodiment of the present invention.

FIG. 13 is a flowchart of the verification process as one embodiment of the present invention.

The verification process comprises steps S1-1 to S1-8.

In step S1-1, the setting region is cut out from an image supplied from the image obtaining unit 132.

Figure 14:
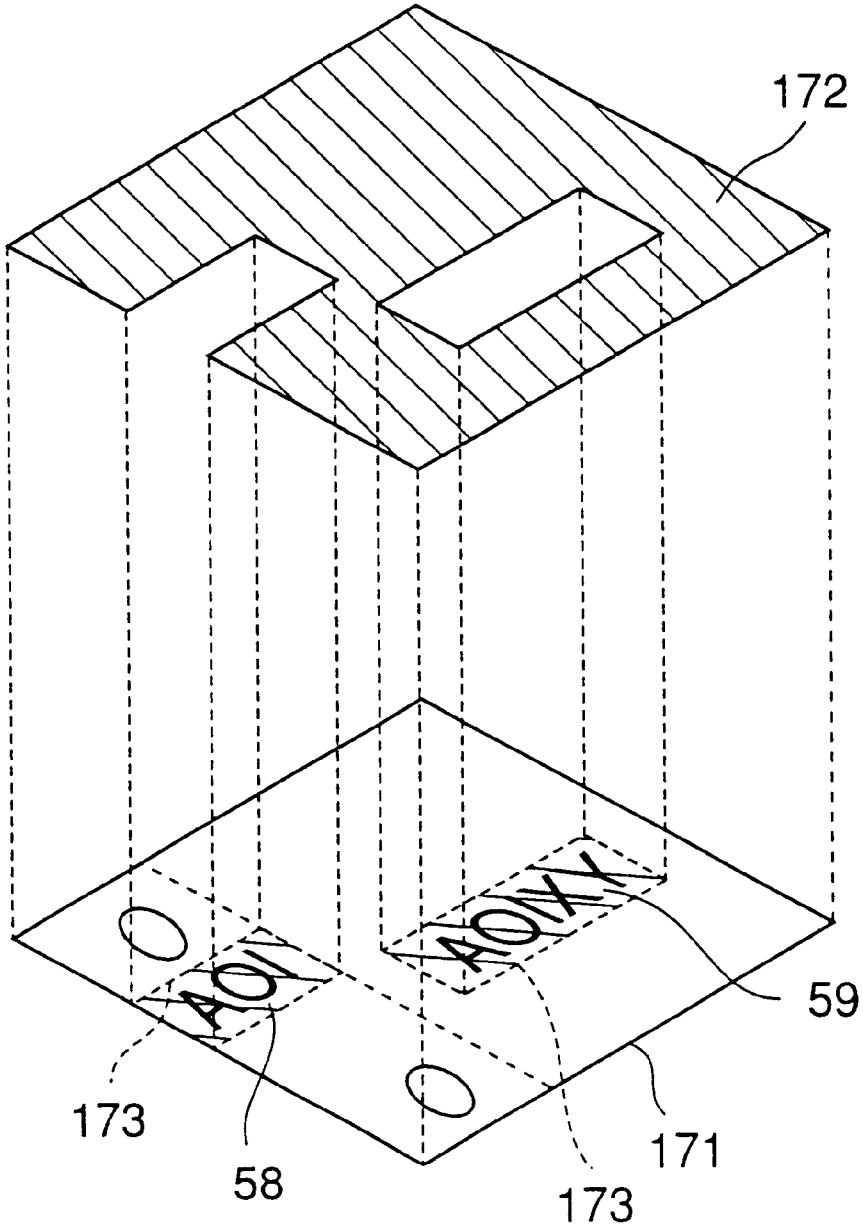
FIG. 14 shows an operation of a set region cutout process performed in the embodiment of the present invention.

FIG. 14 illustrates the setting region cut-out process in one embodiment of the present invention.

In step S1-1, only the images of regions 173 and 174 that are predetermined by overlapping a mask 172 set by the information setting/storing unit 161 on an image 171 supplied from the image obtaining unit 132 are cut out. By doing so, the image of the recording sheet identification information 58 is cut out from the region 173, and the image of the data identification information 59 is cut out from the region 174.

In step S1-2, the images cut out in step S1-1 are converted into character codes. More specifically, the images of the regions 173 and 174 cut out in step S1-1 are converted into character codes by a character recognition technology that is used in the OCR (Optical Character Recognition) system. Through this process, the recording sheet identification information 58 and the data identification information 59 are obtained.

In step S1-3, the recording sheet identification information 58 converted in step S1-2 is compared with the data identification information 59 also converted in step S1-2. The recording sheet identification information 58 is made up of three alpha-numeric characters. The data identification information 59 has the upper three digits that correspond to the recording identification information 58 of the recording sheet 52 to be printed. In such a case, it is determined in step S1-3 whether or not the recording identification information 58 coincides with the upper three digits of the data identification information 59. The data identification information 59 does not always coincide with the recording sheet identification information 58 of the recording sheet 52 to be printed. In such a case, the correspondence between the recording sheet identification information 58 and the data identification information 59 should be set in advance through the input unit 64 for easy reference.

If it is determined in step S1-3 that the recording sheet identification information 58 corresponds to the data identification information 59, the printing operation is carried on in step S1-4. On the other hand, if it is determined in step S1-3 that the recording sheet identification information 58 does not correspond to the data identification information 59, the status code of a error notification is transmitted to the printer device 3 via the communication cable 16. In the printer device 3, the command transmission/reception unit 15*a* receives the status code of an error notification from the verification device 4. The command transmission/reception unit 15*a* in turn supplies the error notification to the data processing unit 11.

Figure 15:
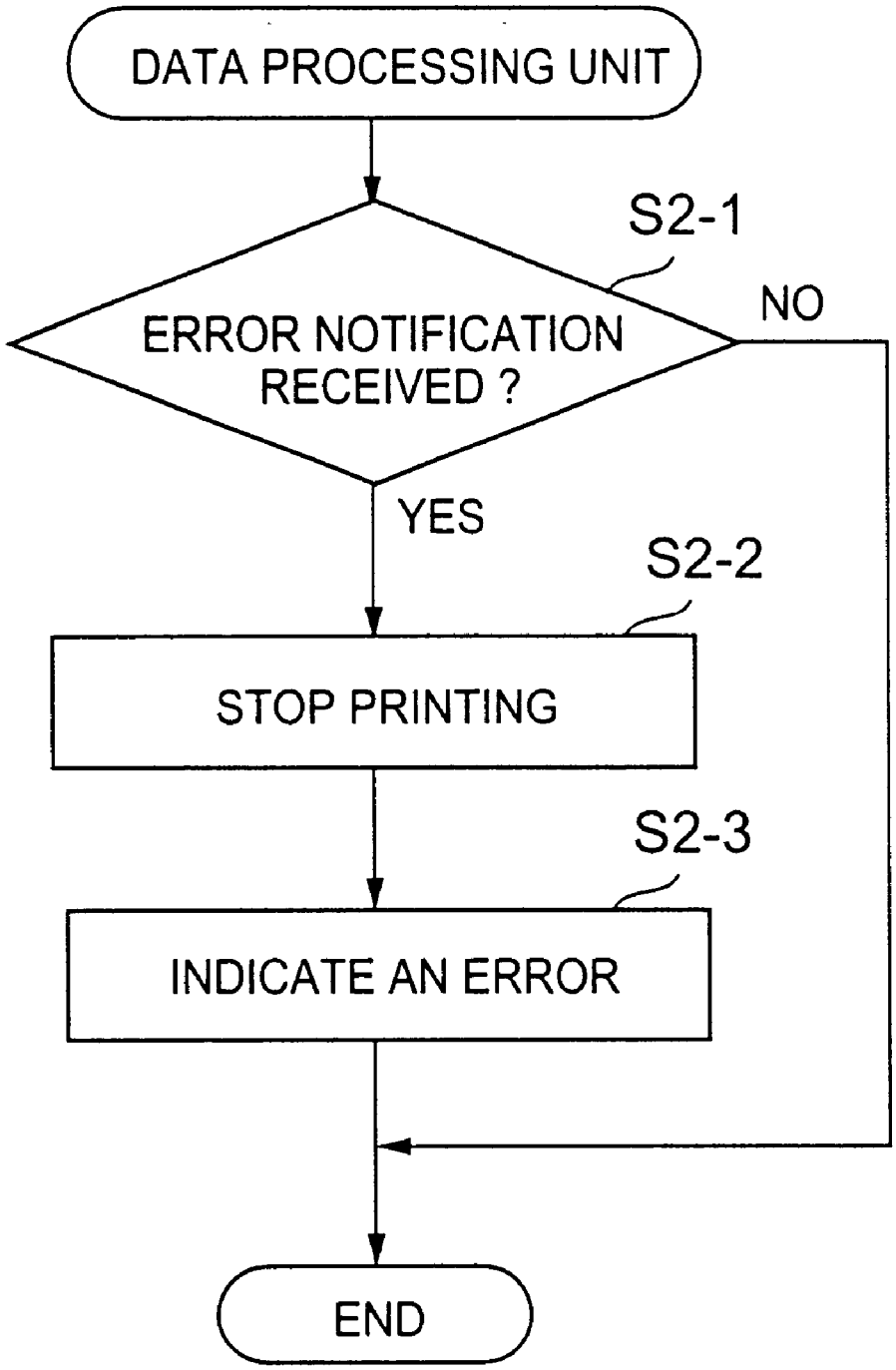
FIG. 15 is a flowchart of an operation performed by the data processing unit of the printer device employed in the embodiment of the present invention.

FIG. 15 is a flowchart-of an operation performed by the data processing unit of the printer device in one embodiment of the present invention.

The data processing unit carries out steps S2-1 to S2-3. In step S2-1, it is determined whether or not an error notification has been received from the command transmission/reception unit 15*a*.

If it is determined in step S2-1 that an error notification has been received from the command transmission/reception unit 15*a*, the operation moves on to step S2-2. In step S2-2, the mechanism control unit 12 is controlled to stop the printing operation. After the stop of the printing operation, the operation moves on to step S2-3, in which an error in the display 13 is indicated. When the printing operation is stopped, an error can be recognized by checking the display 13.

The data processing unit 11 may send an error notification to the host computer 2 instead.

In accordance with this embodiment, even if a printing sheet 51 having a format on which the data to be printed should not be printed is set in the sheet feeding unit 31 of the printer device 3, the verification device 4 automatically detects the wrong setting, and stops the printing operation. Thus, unnecessary data printing can be prevented, and a waste of printing time and printing sheet can be reduced.

In the image obtaining timing generating unit 131 of the verification device 4 of the foregoing embodiments, the image obtaining timing is determined from the reset timing of the counter 151 and the count value by the timer data. However, it is also possible to control the image obtaining timing based on the flash light emission timing of the fixing unit 40, for instance.

Figure 16:
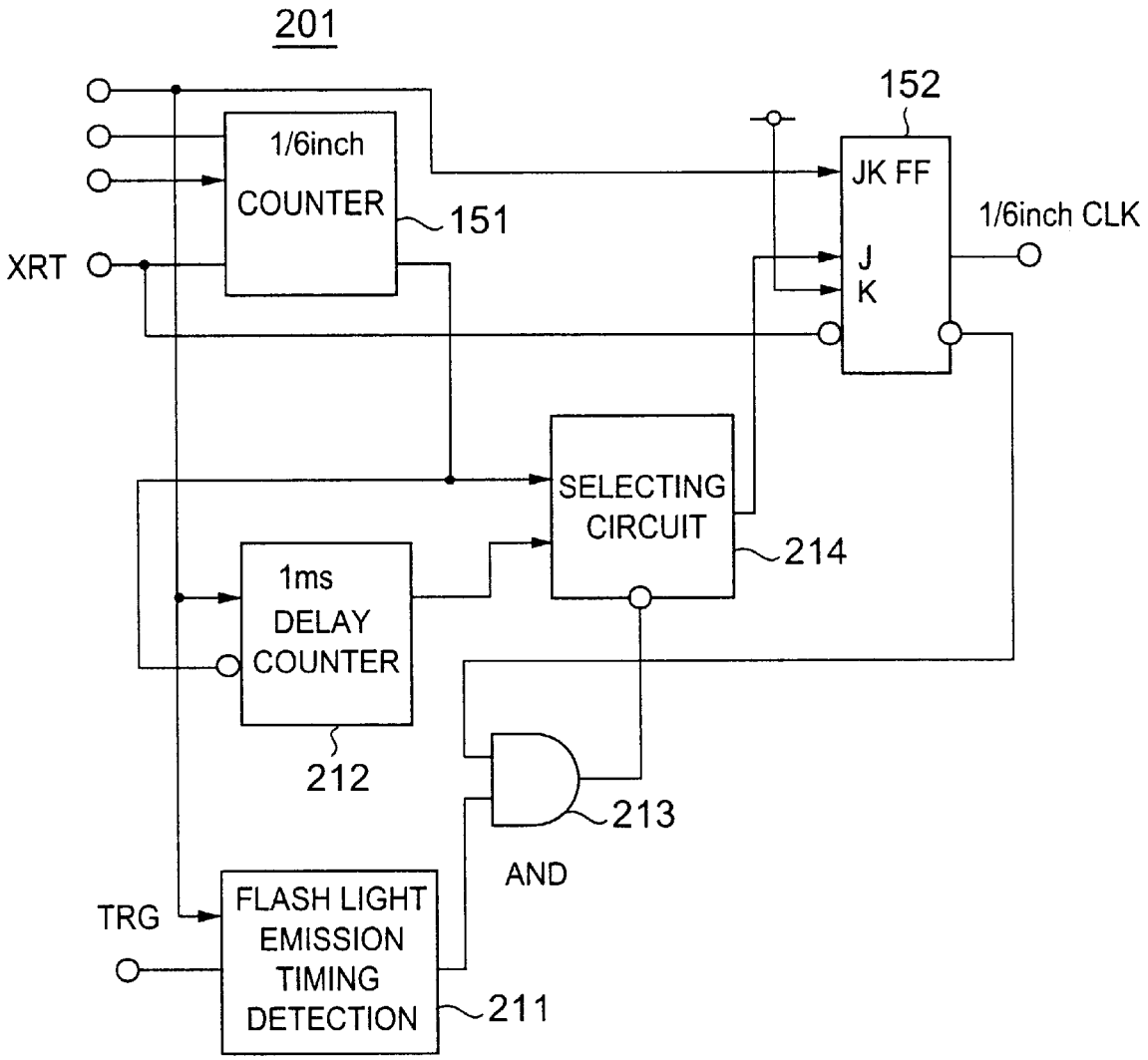
FIG. 16 is a block diagram of a modification of the image read timing generating unit of the embodiment of the present invention.

FIG. 16 shows the block diagram of a modification of the image obtaining timing generating unit 131. In this figure, the same components as in FIG. 11 are denoted by the same reference numerals.

An image obtaining timing generating unit 201 of this modification comprises a flash light emission timing detecting unit 211, a delay counter 212, an AND gate 213, and a selecting circuit 214, as well as the counter 151 and the flip-flop 152.

The flash light emission timing detecting unit 211 receives a trigger signal from the printer device 3 so as to make the fixing unit 40 emit light. The flash light emission timing detecting unit 211 detects a rise of the trigger signal from the printer device 3, and generates a flash light emission timing signal. The flash light emission timing signal generated by the flash light emission timing detecting unit 211 is supplied to the AND gate 213.

The delay counter 212 delays the output pulse of the counter 151 by 1 msec. The output pulse of the delay counter 212 is supplied to the selecting circuit 214. The selecting circuit 214 also receives the output pulse of the counter 151. Based on the output of the AND gate 213, the selecting circuit 214 selects either the output pulse of the counter 151 or the output pulse of the delay counter 212. When the output pulse of the AND gate 213 is high, the selecting circuit 214 outputs the output pulse of the delay counter 212. When the output pulse of the AND gate 213 is low, the selecting circuit 214 outputs the output pulse of the counter 151.

The output pulse of the selecting circuit 214 is supplied to the flip-flop 152. The flip-flop 152 is toggled by the output pulse of the selecting circuit 214. The non-inverted output of the flip-flop 152 is outputted as the image obtaining timing signal. The inverted output of the flip-flop 152 is supplied to the AND gate 213.

Figures 17A, 17B, 17C:
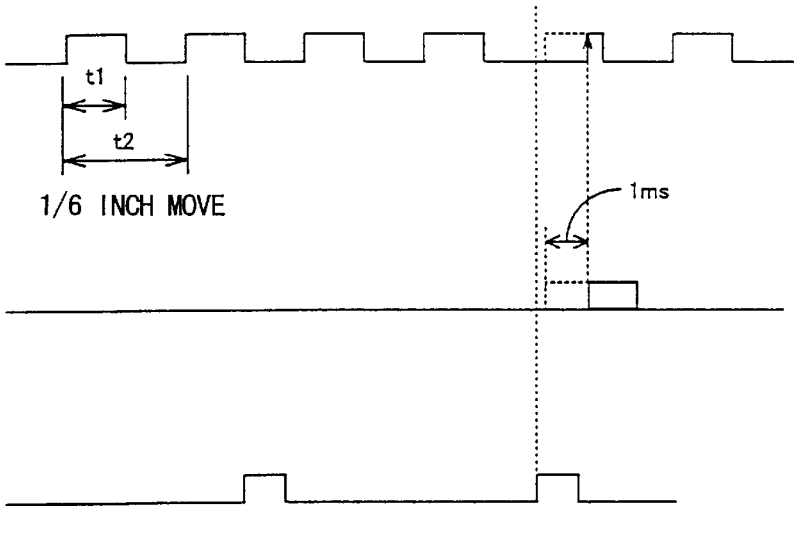
FIGS. 17A to 17C illustrate an operation performed by the modification of the image read timing generating unit employed in the embodiment of the present invention.

FIGS. 17A to 17C illustrates an operation performed by the modification of the image obtaining timing generating unit. More specifically, FIG. 17A shows the sheet transportation clock, FIG. 17B shows the image obtaining timing signal, and FIG. 17C shows the flash light emission trigger signal for the fixing unit 40.

In the above circuit, at the flash light emission timing shown in FIG. 17C, the image obtaining timing is delayed by 1 ms, as shown in FIG. 17B. Accordingly, the image obtaining timing does not overlap with the flash light emission timing, thereby preventing adverse influence of the flash light emission of the fixing unit 40 on an obtained image.

In the foregoing embodiments, the image obtaining timing is determined by resetting the counter when a predetermined period of time has passed since the start of autoloading. However, it is also possible to set the location of the downstream end of each recording sheet.

Figure 18:
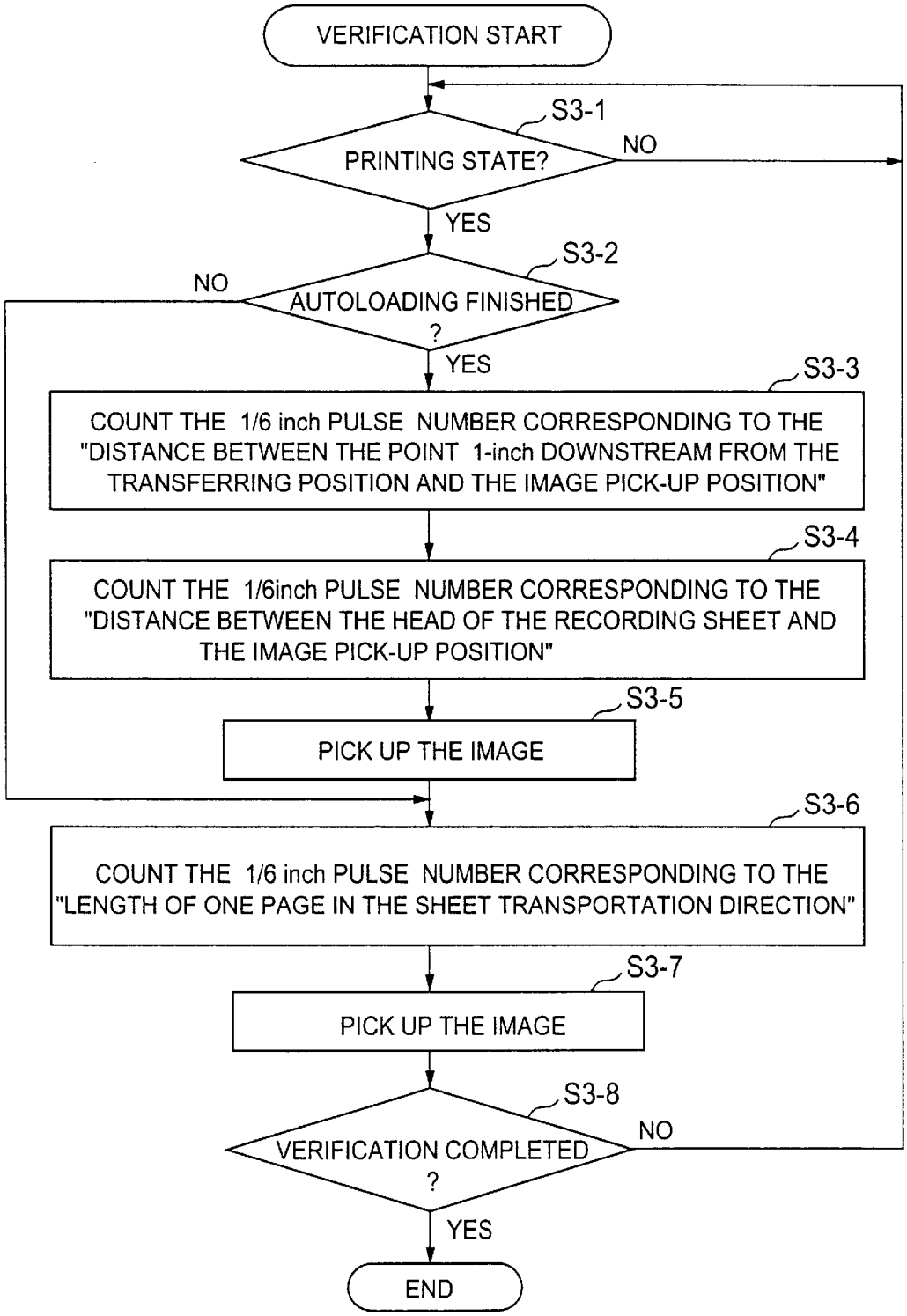
FIG. 18 is a flowchart of a modification of the verification process performed in the embodiment of the present invention.

FIG. 18 is a flowchart of a modification of the verification process in accordance with the present invention. FIGS. 19A to 20B illustrates the operation according to the modification of the verification process.

Figures 19A, 19B, 19C, 19D, 19E:
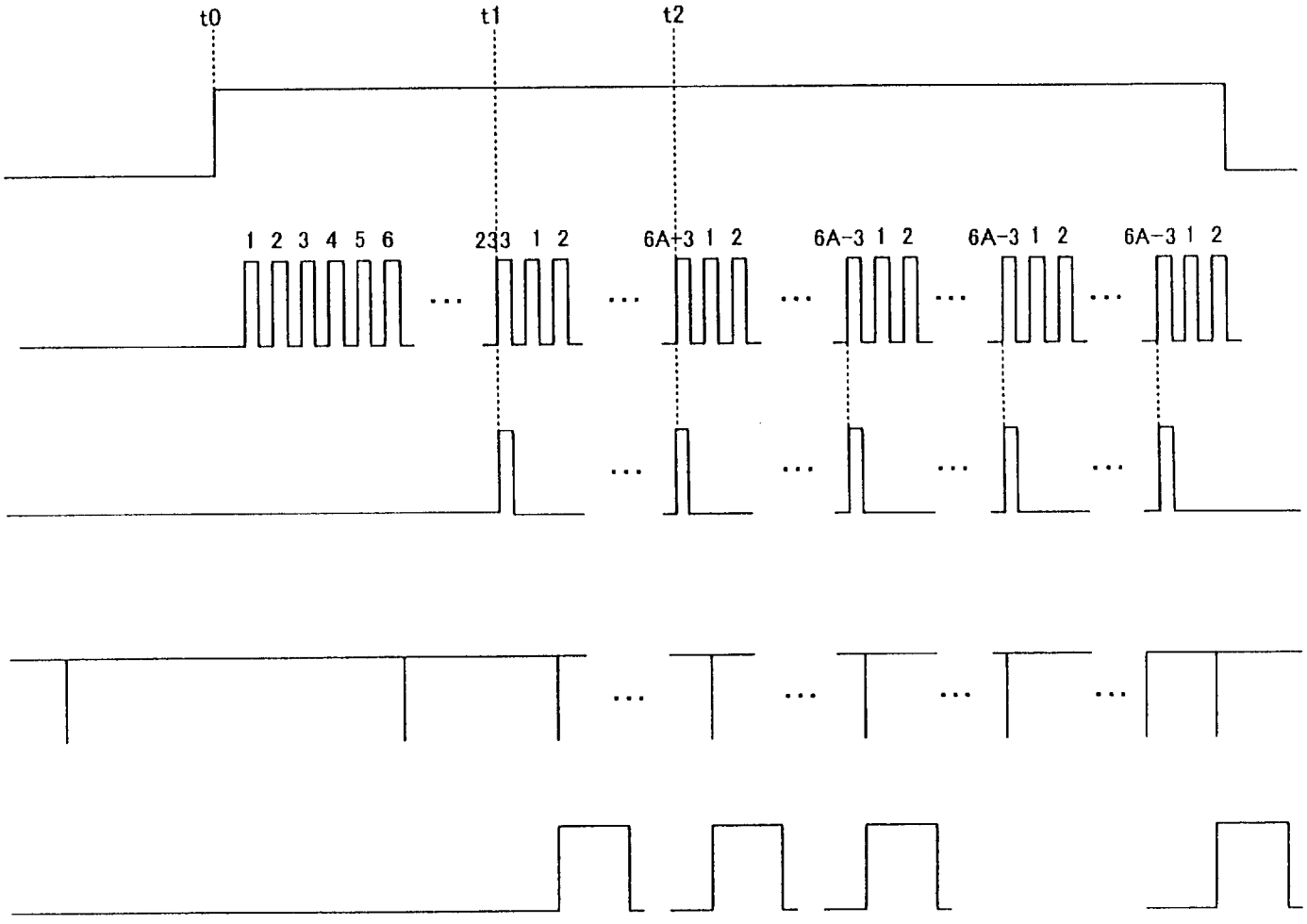
FIGS. 19A to 19E illustrate an operation in accordance with the modification of the verification process.

More specifically, FIG. 19A shows the valid/invalid signal, FIG. 19B shows the sheet transportation clock, FIG. 19C shows the image obtaining timing signal, FIG. 19D shows the image obtaining pulse of the image pick-up device 72, and FIG. 19E shows the verification timing of the verification processing unit 162.

In this modification, the interface unit 62 is contained in the processing unit 63, and the image obtaining and verification processes are performed in accordance with a predetermined program.

The processing unit 63 of this modification performs steps S3-1 to S3-8. In step S3-1, it is determined whether or not the current state is a printing state, in accordance with the valid/invalid signal supplied from the printer device 3. When the valid/invalid signal is in the valid state, it is determined to be in the printing state. For instance, time t0 in FIG. 19A is determined to be in the printing state.

If it is determined in step S3-1 that the current state is the printing state, the operation moves on to step S3-2. In step S3-2, it is determined whether or not the autoloading operation has been finished, based on a command supplied from the printer device 3.

If it is determined in step S3-2 that the autoloading operation has been finished, the operation moves on to step S3-3. In step S3-3, the sheet transportation clock is counted until reaching the value corresponding to the distance between a location 1-inch downstream from the transferring position and the image pick-up position. By step S3-3, the distance between the head of the recording sheet 52 to be first printed and the image pick-up position can be detected. The count value obtained in step S3-3 is an estimated value. After the autoloading operation, the location of transferring from the photosensitive drum 34 to the printing sheet 51, i.e., the point one-inch downstream from the point P0 in FIG. 3 is the location of the end portion of the recording sheet 52 to be first printed. The location can be corrected by simply changing the count value. Through step S3-3, the head of the recording sheet 52 to be first printed can be detected at the image pick-up point.

The operation next moves on to step S3-4. In step S3-4, the sheet transportation clock is counted so as to detect the distance between the head of the recording sheet 52 and the image pick-up point. The count value is determined from the length of the sheet transmitted in accordance with a command issued from the printer device 3, i.e., the information as to the length of the recording sheet 52 and the distance between the lower end of the recording sheet 52 and the image pick-up point. The clock is counted until it reaches the value corresponding to the distance determined by subtracting the distance between the lower end of the recording sheet 52 and the image pick-up point from the length of the recording sheet 52. Through steps S3-3 and S3-4, the image obtaining timing for the first recording sheet 52 is determined. For instance, time t1 shown in FIGS. 19B and 19C serves as the image obtaining timing.

In step S3-5, an image is actually obtained. The image of a predetermined region is obtained from the first recording sheet 52, i.e., the recording sheet identification information 58 and the data identification information 59 are obtained from the first recording sheet 52.

In step S3-6, the sheet transportation clock is counted by the length of the recording sheet 52. Through step S3-6, the image obtaining timing for a next recording sheet 52 is detected. For instance, time t2 shown in FIGS. 19B and 19C is detected as the image obtaining timing.

In step S3-7, the image of a predetermined image pick-up area is obtained from the next recording sheet 52, i.e., the recording sheet identification information 58 and the data identification information 59 are obtained from the next recording sheet 52.

Figure 20A:
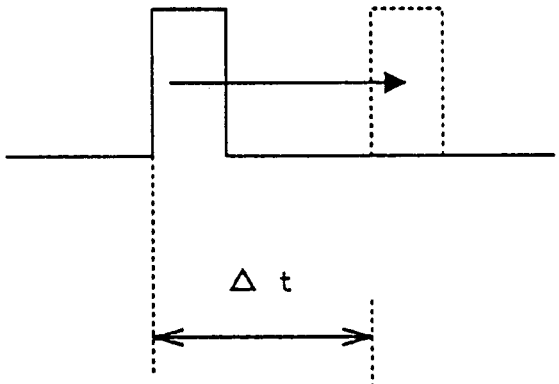
FIGS. 20A and 20B illustrate an operation in accordance with the modification of the verification process.
Figure 20B:
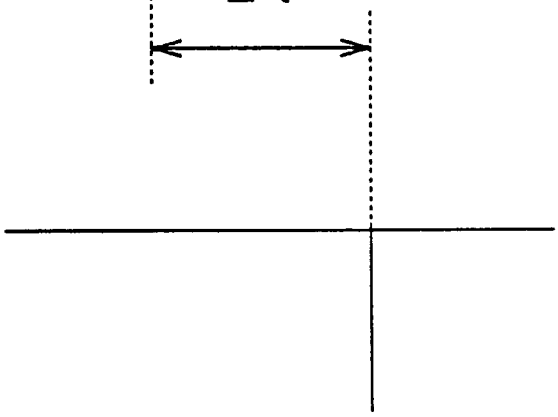

As shown in FIGS. 20A and 20B, if the image obtaining timing of the processing unit 63 comes immediately before, less than 50 $\mu$s before, for instance, the image obtaining timing of the image pick-up device 72, the image obtaining timing of the processing unit 63 is delayed for the time until immediately after the image obtaining timing of the image pick-up device 72, as indicated by the broken line in FIG. 20A. By doing so, a failure to pick up an image can be prevented.

Next, the conditions for picking up the entire image of one recording sheet 52.

To pick up the entire image of a recording sheet 52, the following equation needs to be satisfied:

$$V/F \leq AY \quad (1)$$

where V is the sheet transportation velocity, F is the image pick-up frequency of the image pick-up device 72, and AY is the length of the recording sheet 52.

Figure 21:
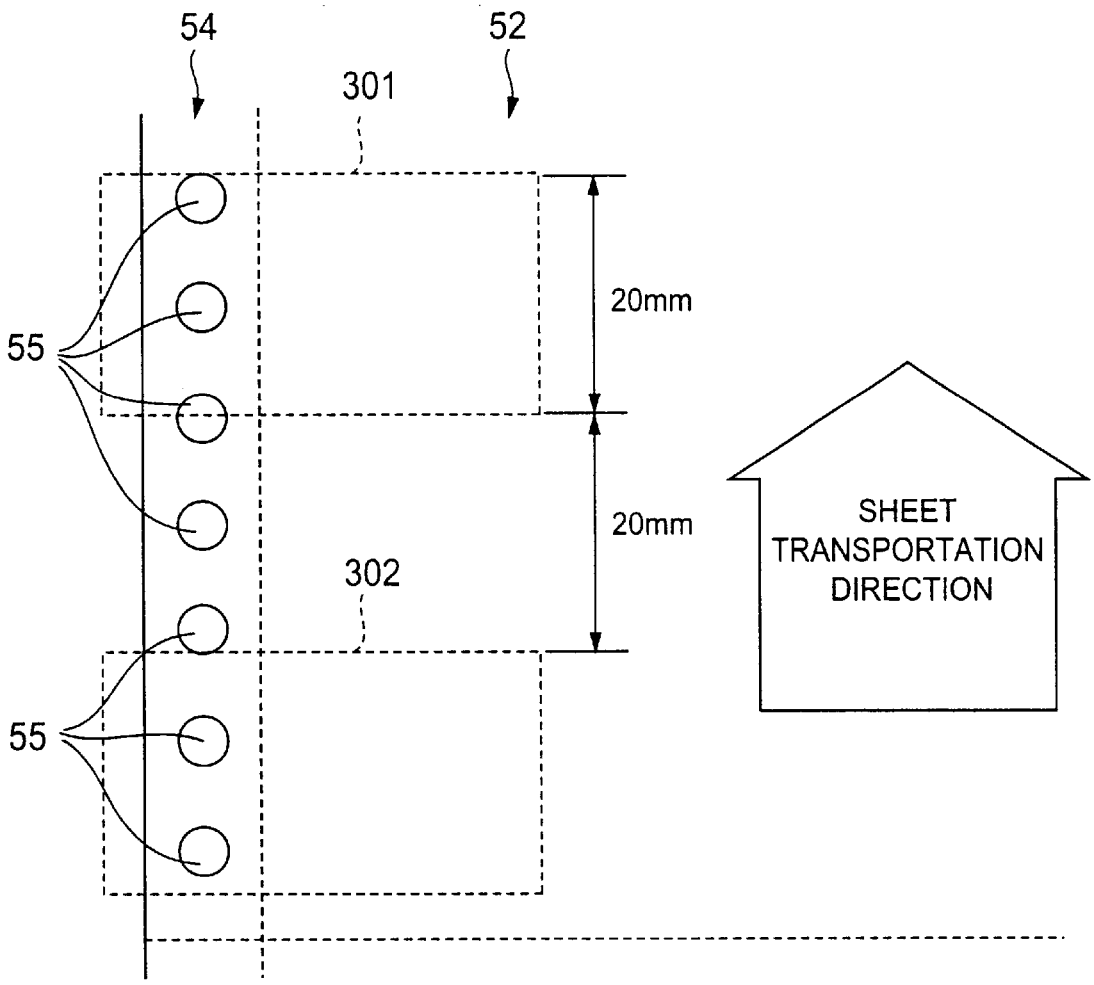
FIG. 21 illustrates an image pick-up operation performed in the embodiment of the present invention.
Figure 22:
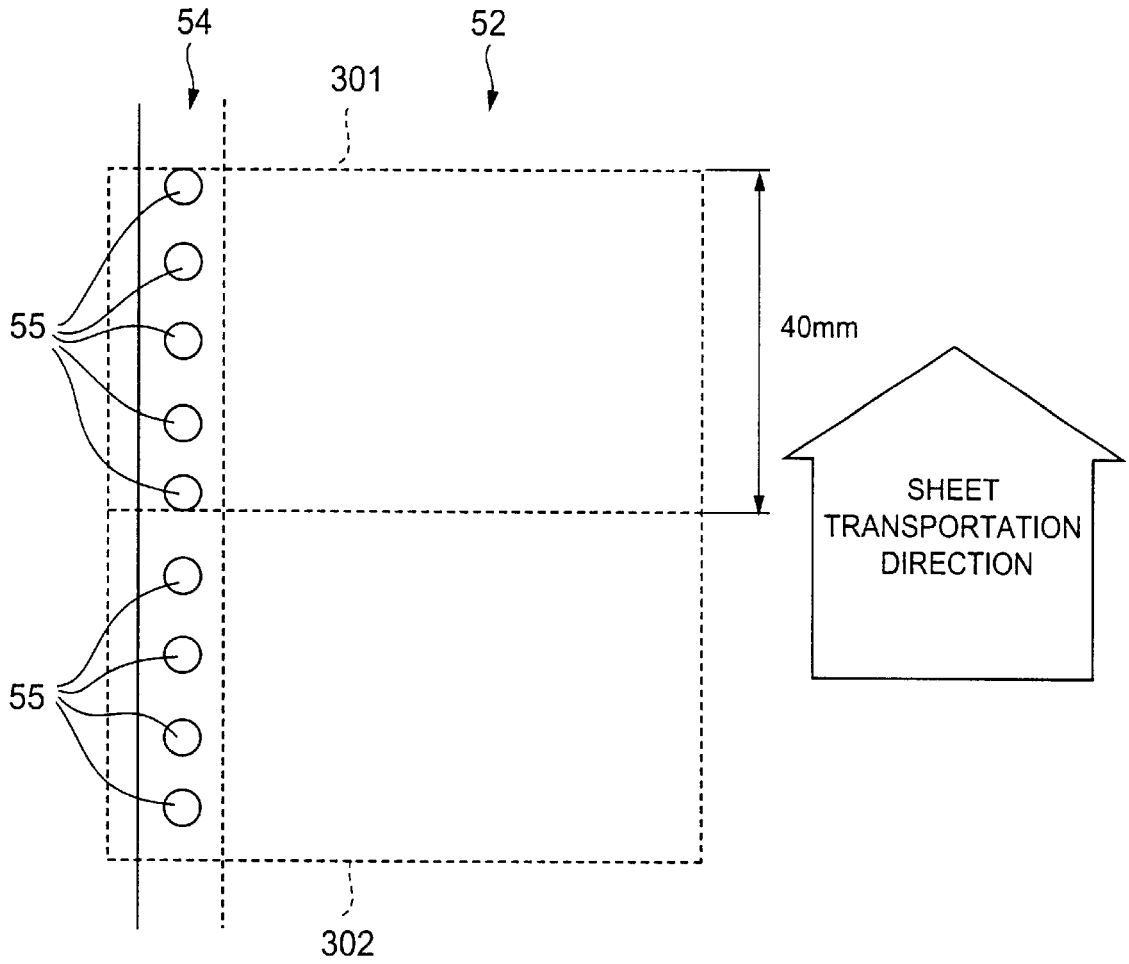
FIG. 22 illustrates an image pick-up operation performed in the embodiment of the present invention.
Figure 23:
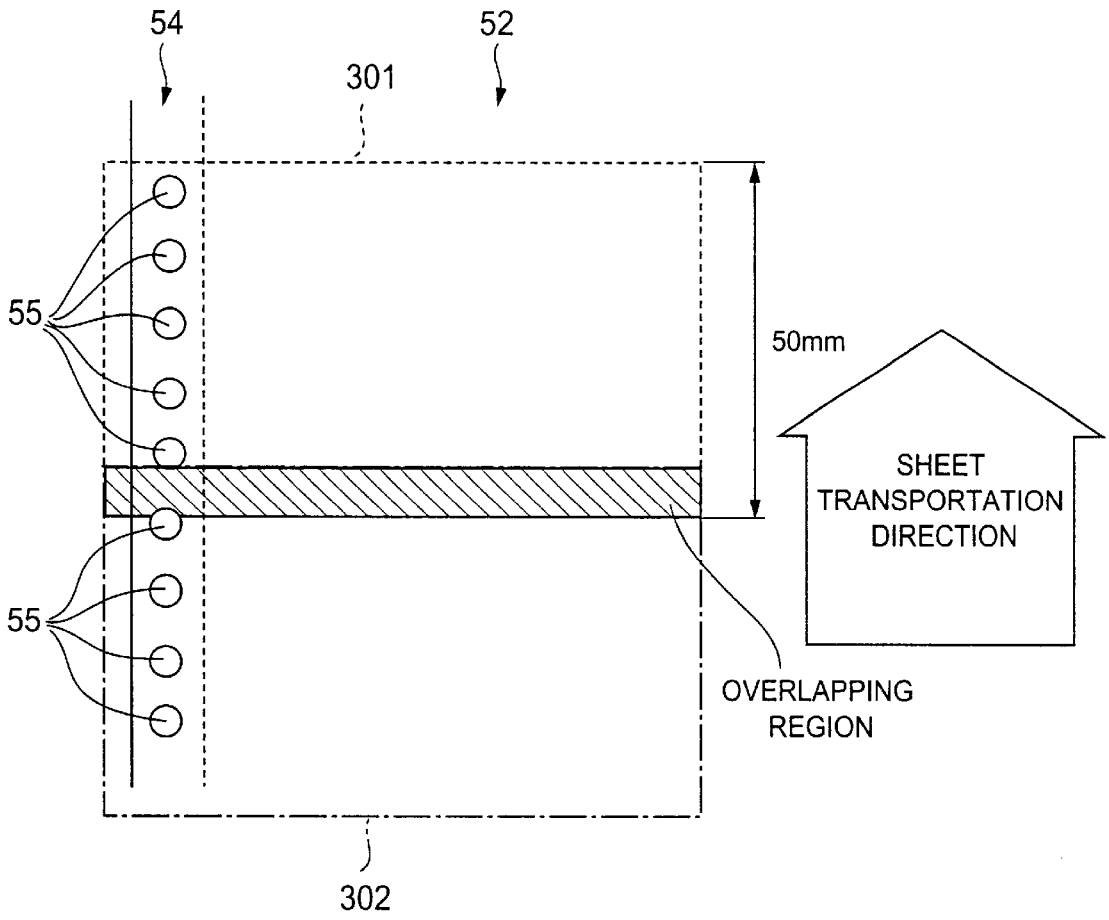
FIG. 23 illustrates an image pick-up operation performed in the embodiment of the present invention.

FIGS. 21 to 23 illustrate the image pick-up operation in accordance with the present invention.

The sheet transportation velocity V is 1200 mm/s, and the image pick-up frequency F of the image pick-up device 72 is 30 Hz, for instance.

If the range AY that can be read by onetime image obtaining process is 20 mm, as shown in FIG. 21, i.e., the equation (1) is not satisfied, a gap of 20 mm is formed between a first image pick-up region 301 and a second image pick-up region 302. As a result, the image of the gap of 20 mm cannot be obtained.

If the range AY that can be read by onetime image obtaining process is 40 mm, as shown in FIG. 22, i.e., the equation (1) is satisfied, there is no gap formed between the first image pick-up region 301 and the second image pick-up region 302. Accordingly, the image of the entire region can be obtained.

If the range AY that can be read by onetime image obtaining process is 50 mm, as shown in FIG. 23, i.e., the equation (1) is satisfied, the first image pick-up region 301 partially overlaps with the second image pick-up region 302, and there is no gap formed between the first image pick-up region 301 and the second image pick-up region 302. Accordingly, the image of the entire region can be obtained.

As is apparent from the above description, to obtain the image of the entire region of a recording sheet with the sheet transportation velocity V of 1200 mm/s and the image pick-up frequency F of 30 Hz, the image obtainable range AY should be 40 mm or larger.

In this embodiment, the distance between the recording identification information 58 and the data identification information 59 is set within 45 mm, and the image obtainable range is 45 mm. With the sheet transportation velocity V of 1200 mm/s and the image pick-up frequency F of 30 Hz, both the recording sheet identification information 58 and the data identification information 59 can be obtained by one-time image obtaining process. To do so, the light path needs to be long enough. However, with a long light path, the image pick-up unit takes up a large space. To maintain a long light path and compactness, the image pick-up unit 61 needs to have the structure shown in FIG. 5.

In the foregoing embodiments, both the recording sheet identification information 58 and the data identification information 59 can be obtained by one-time image obtaining process. However, when the image obtainable range needs to be small, the image of the recording identification information 58 can be obtained separately from image of the data identification information 59.

Figure 24:
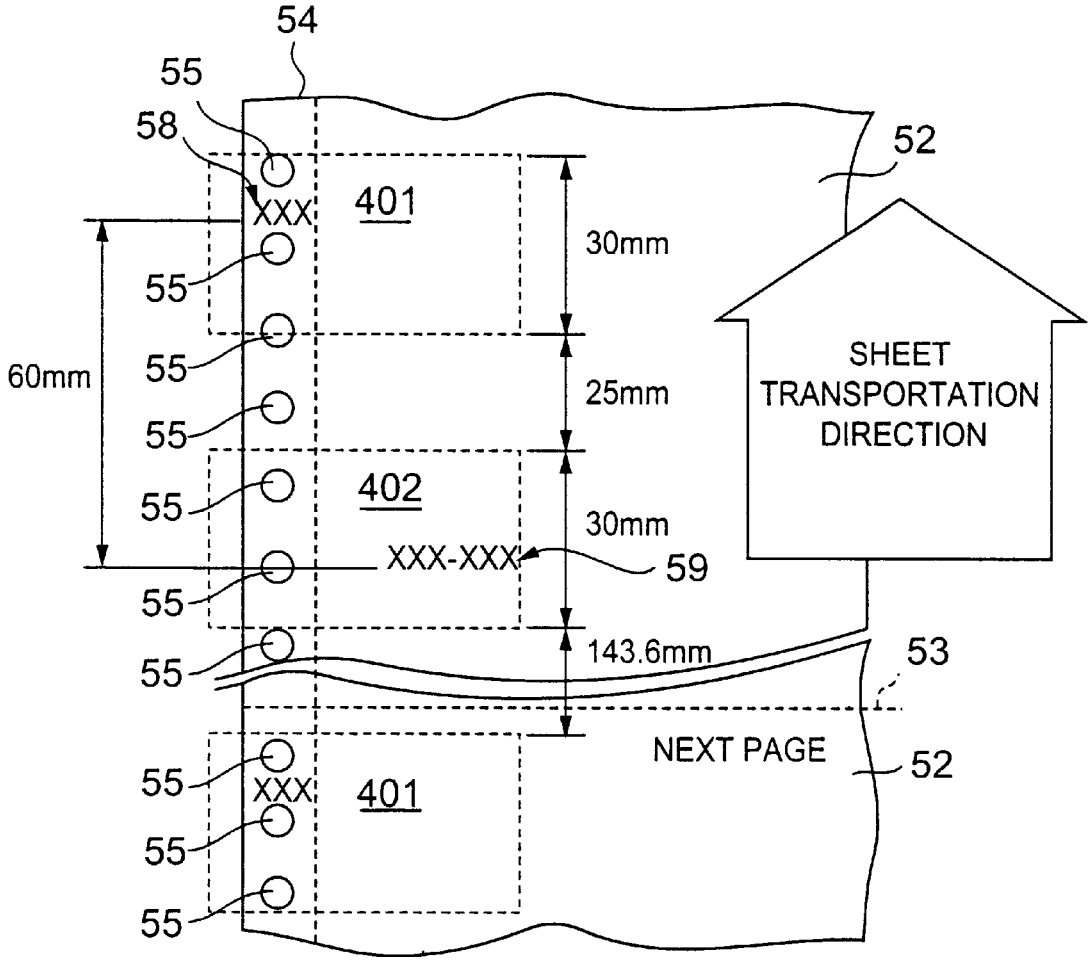
FIG. 24 illustrates an operation of a modification of the image read operation performed in the embodiment of the present invention.

FIG. 24 illustrates a modification of the image obtaining operation in accordance with the present invention. In this figure, the same components as in FIG. 4 are denoted by the same reference numerals.

In this modification, the sheet transportation velocity V is 1200 mm/s, the image pick-up frequency F of the image pick-up device 72 is 30 Hz, and the image pick-up length of a first image pick-up region 401 and a second image pick-up region 402 is 30 mm. Under these conditions, a 20-mm region that cannot be picked up is formed, as shown in FIG. 21. In order to obtain both images of the first image pick-up region 401 and the second image pick-up region 402, a gap of 25 mm is maintained between the first image pick-up region 401 and the second image pick-up region 402, as shown in FIG. 24.

To obtain the image of the recording sheet identification information 58 in the first image pick-up region 401 and the image of the data identification information 59 in the second image pick-up region 402, the gap between the recording sheet identification information 58 and the data identification information 59 should be 60 mm, for instance.

In this modification, the sheet transportation velocity V is 1200 mm/s, the image pick-up frequency F of the image pick-up device 72 is 30 Hz, and the image pick-up length of the first image pick-up region 401 and the second image pick-up region 402 is 30 mm. However, the pitches of the first image pick-up region 401 and the second image pick-up region 402 can be set so as to satisfy the following equation:

$$V/F \leqq DL \quad (2)$$

where DL is the pitch of the first image pick-up region 401 and the second image pick-up region 402, V is the sheet transportation velocity, and F is the image pick-up frequency of the image pick-up device 72.

In the foregoing embodiments, the verification device 4 compares the recording sheet identification information 58 with the data identification information 59. However, the comparison operation can be performed in the printer device 3 or the host computer 2.

The present invention is not limited to the specifically disclosed embodiments, but variations and modifications may be made without departing from the scope of the present invention.

The present application is based on Japanese priority application No. 2000-273828, filed on Sep. 8, 2000, the entire contents of which are hereby incorporated by reference.

What is claimed is:

1. A printer system which prints data containing data identification information for identifying the type of data to be printed on a predetermined recording sheet having recording sheet identification information for identifying the type of recording sheet printed in advance thereon, said printer system comprising:

an image pick-up unit that picks up an image of the recording sheet; and a processing unit that extracts images of the recording sheet identification information and the data identification information from the image of the recording sheet picked up by the image pick-up unit, compares the recording sheet identification information with the data identification information, and detects inconsistency between the type of the recording sheet and the type of the data.

2. The printer system as claimed in claim 1, wherein the processing unit transmits an error notification when the type of the recording sheet is different from the type of the data.

3. The printer system as claimed in claim 1, wherein the processing unit stops a printing operation when the type of the recording sheet is different from the type of the data.

4. The printer system as claimed in claim 1, wherein the processing unit obtains the recording sheet identification information and the data identification information by one image reading operation.

5. The printer system as claimed in claim 1, wherein a transportation velocity V of the recording sheet, an image pick-up frequency F of the image pick-up unit, and the length of an image pick-up area are set in such a manner as to satisfy the equation, $V/F \leqq AY$.

6. The printer system as claimed in claim 1, wherein:

the processing unit acquires the recording sheet identification information and the data identification information from a first image pick-up region and a second image pick-up region, respectively; and a transportation velocity V of the recording sheet, an image pick-up frequency F of the image pick-up unit, and a pitch DL of the first image pick-up region and the second image pick-up region are set in such a manner as to satisfy the equation, $V/F \leqq DL$.

7. The printer system as claimed in claim 1, wherein the image pick-up unit includes a reflection unit that reflects an image of the recording sheet.

8. The printer system as claimed in claim 1, wherein the image pick-up unit includes a light emitting unit that emits light onto the recording sheet.

9. The printer system as claimed in claim 8, wherein the processing unit obtains an image when the light emitting unit emits light.

10. The printer system as claimed in claim 8, further comprising a brush unit that is located before the image pick-up unit and slides on a printing surface of the recording sheet.

11. A verification device that verifies a recording sheet on which recording sheet identification information for identifying a type of sheet is recorded in advance, and data containing data identification information for identifying a type of data to be printed is also printed, said verification device comprising:

an image pick-up unit that picks up an image of the recording sheet; and a processing unit that extracts images of the recording sheet identification information and the data identification information from the image of the recording sheet picked up by the image pick-up unit, and compares the recording sheet identification information with the data identification information so as to detect inconsistency between a type of the recording sheet and a type of the data.

12. The verification device as claimed in claim 11, wherein the processing unit transmits an error notification when the type of the recording sheet is different from the type of the data.

13. The verification device as claimed in claim 11, wherein the processing unit obtains the recording sheet identification information and the data identification information by one image reading operation.

14. The verification device as claimed in claim 11, wherein the image pick-up unit includes a reflection unit that reflects an image of the recording sheet.

15. The verification device as claimed in claim 11, wherein the image pick-up unit includes a light emitting unit that emits light onto the recording sheet.

16. The verification device as claimed in claim 15, wherein the processing unit obtains an image when the light emitting unit emits light.

* * * * *